US007811240B2

(12) United States Patent
Watanabe et al.

(10) Patent No.: US 7,811,240 B2
(45) Date of Patent: Oct. 12, 2010

(54) LEG MASSAGE MACHINE

(75) Inventors: Tsuyoshi Watanabe, Asago (JP); Tatsuaki Yamamoto, Himeji (JP); Takashi Nakamura, Kasai (JP); Noriyuki Okada, Ono (JP)

(73) Assignee: Sanyo Electric Co., Ltd., Moriguchi-Shi, Osaka (JP)

( * ) Notice: Subject to any disclaimer, the term of this patent is extended or adjusted under 35 U.S.C. 154(b) by 867 days.

(21) Appl. No.: 11/729,412

(22) Filed: Mar. 28, 2007

(65) Prior Publication Data

US 2007/0232968 A1 Oct. 4, 2007

(30) Foreign Application Priority Data

Mar. 31, 2006 (JP) ..... 2006-98125

(51) Int. Cl.
*A61H 7/00* (2006.01)

(52) U.S. Cl. ..... 601/90; 601/27; 601/35; 601/84; 601/148

(58) Field of Classification Search ..... 601/24, 601/27, 34, 35, 84–88, 90, 93, 96, 98, 101, 601/148

See application file for complete search history.

(56) References Cited

U.S. PATENT DOCUMENTS

| | | | | |
|---|---|---|---|---|
| 2003/0050578 | A1* | 3/2003 | Suh | 601/99 |
| 2005/0288612 | A1* | 12/2005 | Suzuki | 601/151 |
| 2006/0293618 | A1* | 12/2006 | Hsieh | 601/133 |
| 2007/0021694 | A1* | 1/2007 | Shiraishi | 601/94 |

FOREIGN PATENT DOCUMENTS

| | | |
|---|---|---|
| JP | SHO 31-16239 | 10/1956 |
| JP | SHO 51-35742 | 9/1976 |
| JP | HEI.06-42379 | 6/1994 |
| JP | 08-216605 | 8/1996 |
| JP | 08-216606 | 8/1996 |
| JP | 09-140424 | 6/1997 |
| JP | 2000-116454 | 4/2000 |
| JP | 2000-299219 | 10/2000 |
| JP | 2004-180967 | 7/2004 |
| JP | 2004-357945 | 12/2004 |
| JP | 2005-245803 | 9/2005 |
| JP | 3116855 | 12/2005 |
| JP | 2006-075436 | 3/2006 |
| WO | WO 2006/033238 A1 | 3/2006 |

* cited by examiner

*Primary Examiner*—Quang D Thanh
(74) *Attorney, Agent, or Firm*—Eckert Seamans Cherin & Mellott, LLC; Kirk D. Houser, Esq.

(57) ABSTRACT

The invention provides a leg massage machine comprising recessed receiving portions and leg receiving portions which are made movable together rockingly for massaging the feet and calves of the user, respectively. The leg massage machine has recessed receiving portions (70) for inserting the respective feet of the user and leg receiving portions (74) for inserting the respective calves of the user, the recessed receiving portions (70) and the leg receiving portions (74) each having massage means on side walls and/or a bottom wall thereof. The massage machine has a base assembly (20) to be placed on the floor, and a reclining movable assembly (50) rockingly movable forward and rearward relative to the base assembly (20). The recessed receiving portions (70) and the leg receiving portions (74) are provided in the reclining movable assembly (50) and movable together rockingly.

16 Claims, 24 Drawing Sheets

LEG MASSAGE MACHINE

FIELD OF THE INVENTION

The present invention relates to leg massage machines for massaging the feet and calves of the user, and more particularly to leg massage machines adapted to give a massage at a variable angle.

BACKGROUND OF THE INVENTION

Leg massage machines are known for massaging the feet and calves of the user.

For example, JP2005-245803A discloses a leg massage machine comprising a foot unit for the user to insert his or her feet thereinto, and a calf unit for inserting the calves thereinto. The foot unit and the calf unit are each provided with massage means, such as air bags, for giving a massage to the user.

With the massage machine disclosed in the above patent literature, the calf unit is connected to the foot unit as placed on the floor forwardly or rearwardly tiltably. When the calves are inclined rearward with the feet placed in the foot unit, the calf unit tilts rearward with the angle of the calves.

The machine thus adapted is capable of giving a massage to the user even when the user is lying down on the floor.

The calf unit is made tiltable relative to the foot unit, so that when the user is seated, for example, in a chair for massaging and if the foot unit is positioned close to the chair, the calf unit will strike against the chair and can not be tilted when to be inclined rearward.

Further since the foot unit is not tiltable, the feet as positioned at an angle with the calves in a natural relaxed state will stretch out from the calves at an altered angle, with the result that the tendon or muscle of the calf or foot will thrust out as tensioned to result in impaired circulation of the blood. Thus, the machine fails to give a fully effective massage.

SUMMARY OF THE INVENTION

An object of the present invention is to provide a leg massage machine comprising recessed receiving portions and leg receiving portions which are made movable together rockingly for massaging the user's feet and calves, respectively.

To accomplish the above object, the present invention provides a leg massage machine which has recessed receiving portions for inserting the respective feet of the user and leg receiving portions for inserting the respective calves of the user, the recessed receiving portions and the leg receiving portions each having massage means on side walls and/or a bottom wall thereof, the machine having:

- a base assembly to be placed on a floor, and
- a reclining movable assembly rockingly movable forward and rearward relative to the base assembly,
- the recessed receiving portions and the leg receiving portions being provided in the reclining movable assembly and movable together rockingly.

The reclining movable assembly, which has the recessed receiving portions and the leg receiving portions, is made rockingly movable relative to the base assembly, so that the reclining assembly inclines while slidingly moving forward and is therefore tiltable without coming into striking contact with a chair or the like which may be positioned in the rear thereof.

The recessed receiving portions and the leg receiving portions are rockingly movable together while being held at a definite angle. This obviates the likelihood that the feet will stretch out from the calves if the reclining movable assembly is inclined rearward, with the result that the reclining movable assembly, even if inclined rearward, is unlikely to thrust out the tendon or muscle of the calf or foot as tensioned, relaxing the tendon or muscle free of tension.

Accordingly, the blood vessel can be free from pressure with the circulation of the blood unimpeded, consequently ensuring a highly effective massage.

DESCRIPTION OF THE PREFERRED EMBODIMENTS

Leg massage machines 10 of the invention will be described below with reference to the drawings.

Embodiment 1

Figure 1:
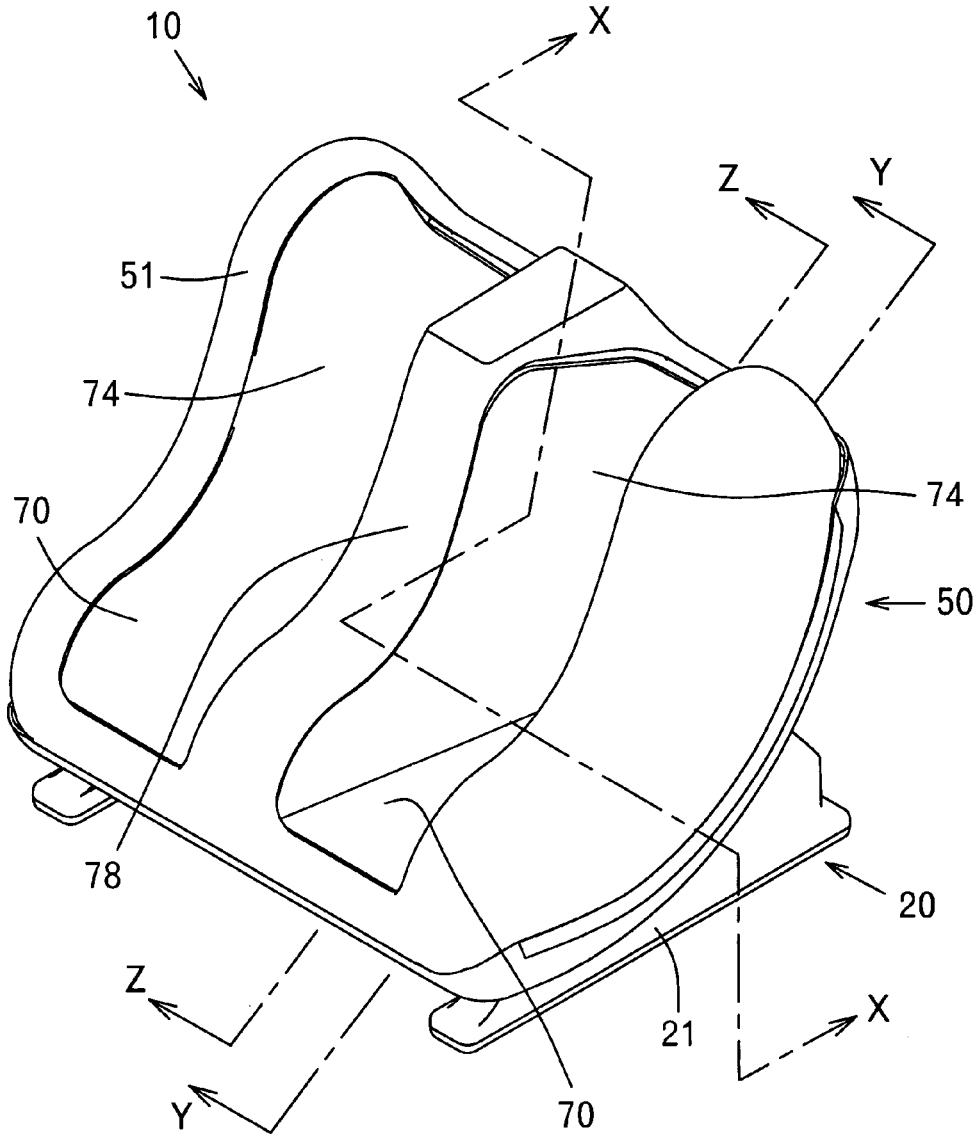
FIG. 1 is a perspective view showing a leg massage machine of the invention as it is seen obliquely from the front.
Figure 2:
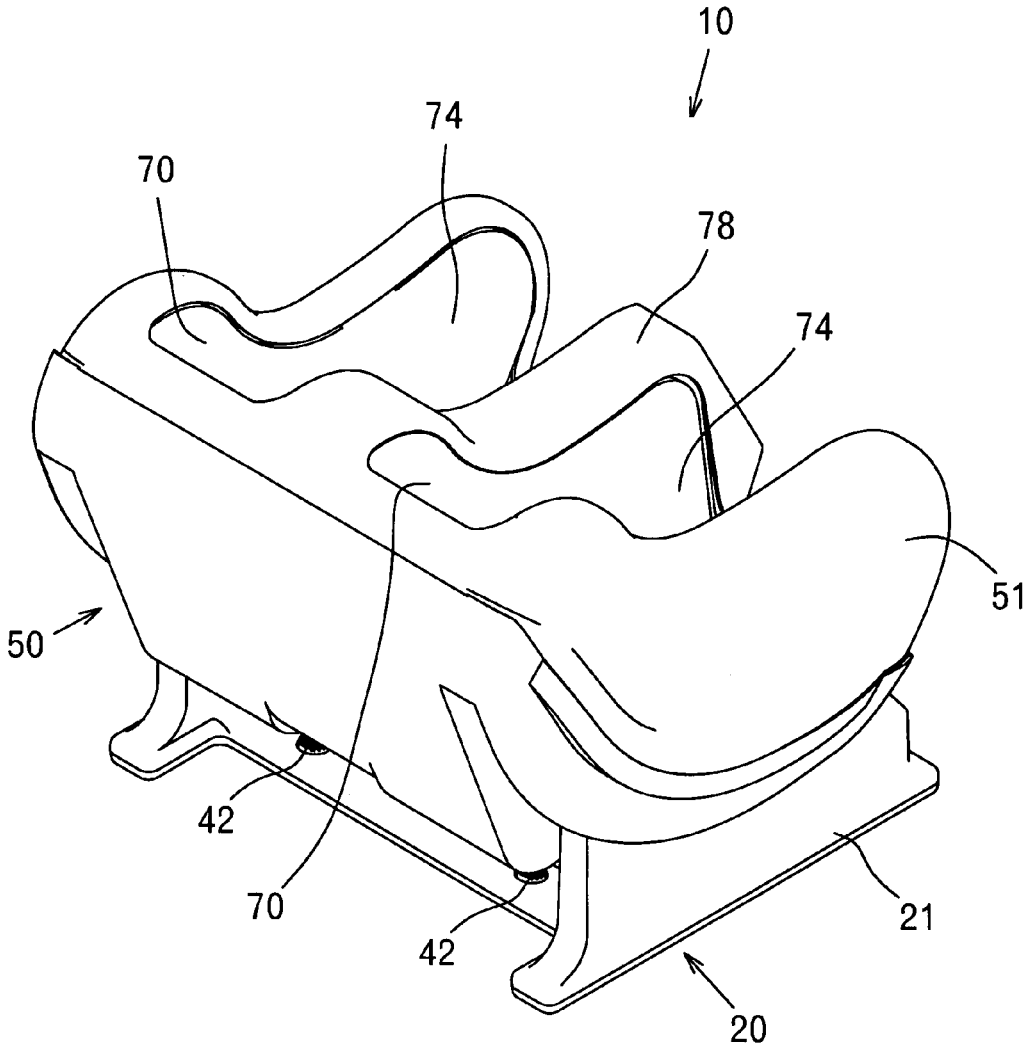
FIG. 2 is a perspective view of the leg massage machine to show a reclining movable assembly as inclined rearward and as seen obliquely from the front.
Figure 3:
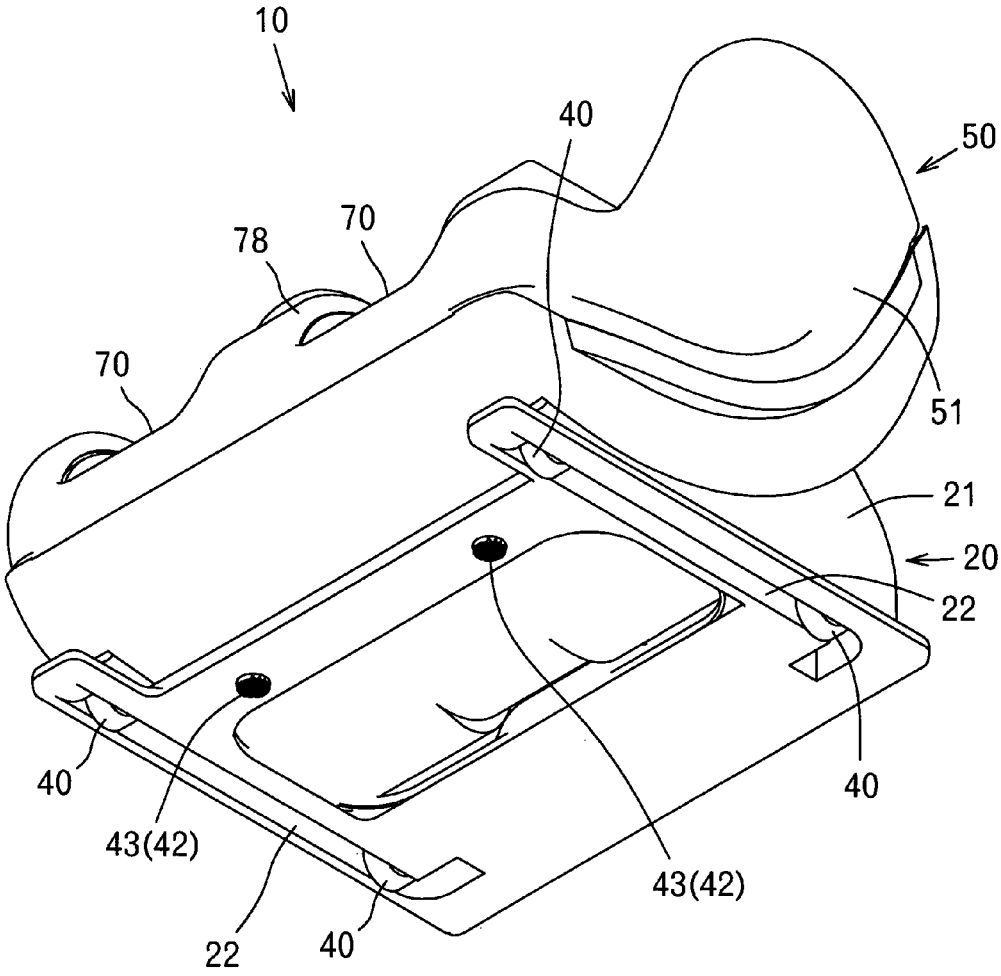
FIG. 3 is a perspective view showing the leg massage machine as it is seen from the bottom side thereof.
Figure 4:
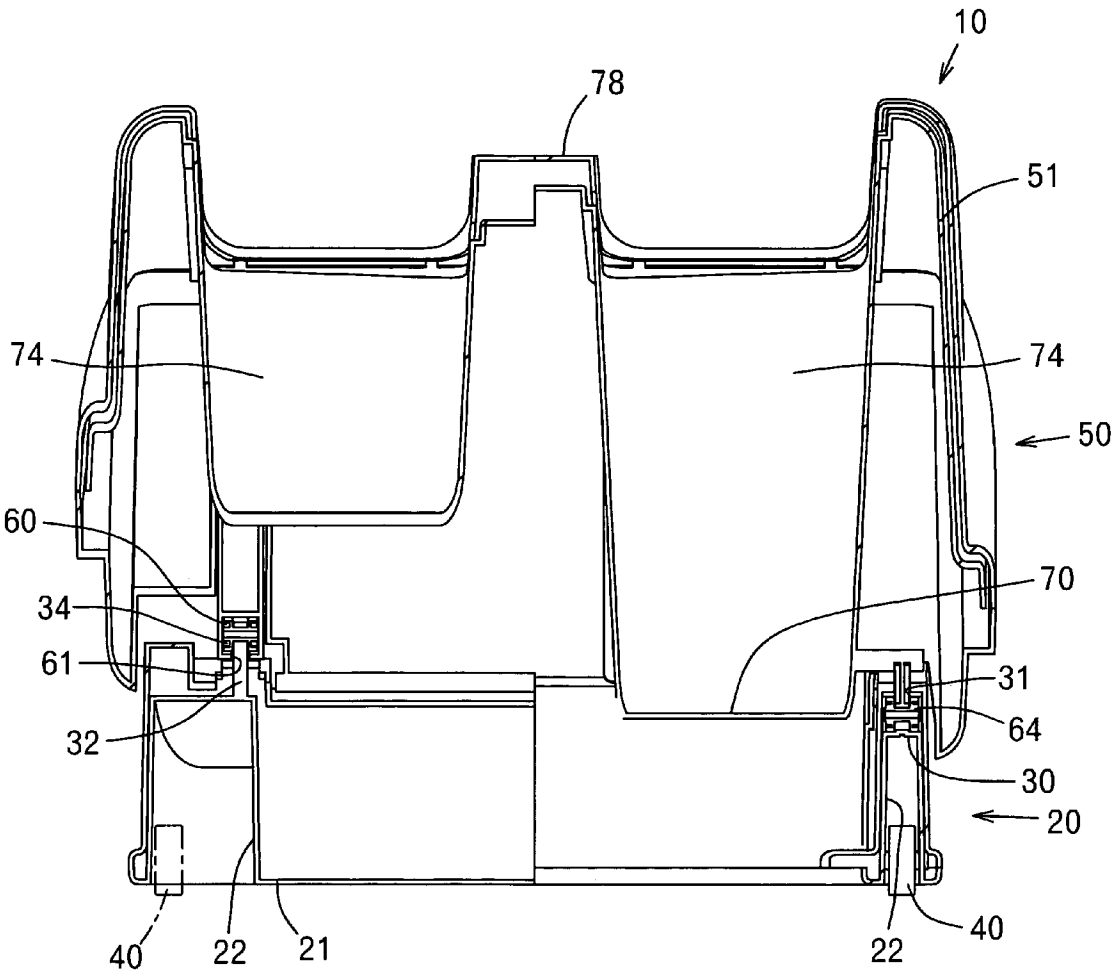
FIG. 4 is a view in section taken along the line X-X in FIG. 1.
Figure 5:
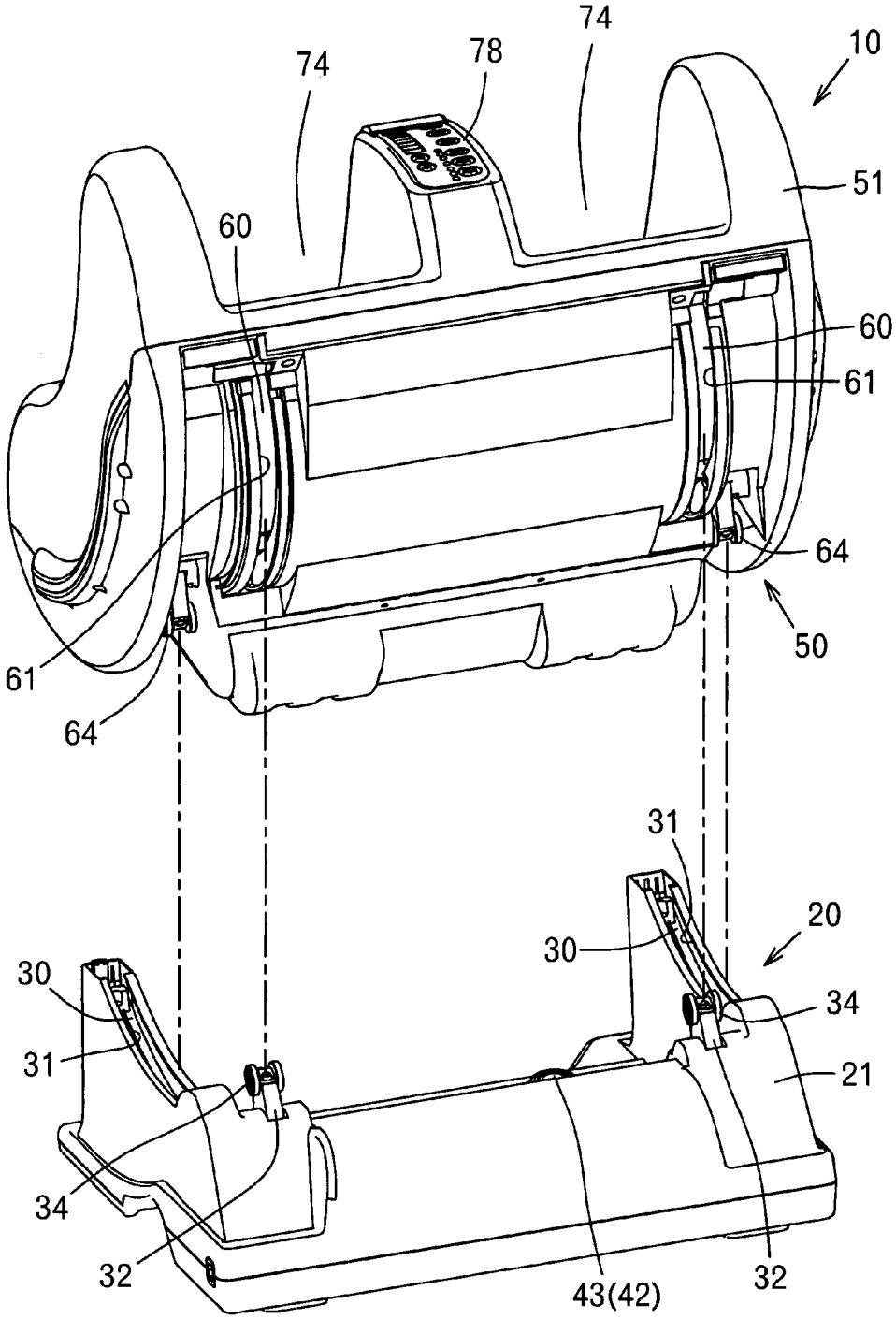
FIG. 5 is a perspective view showing a base assembly and the reclining movable assembly as removed therefrom.
Figure 6:
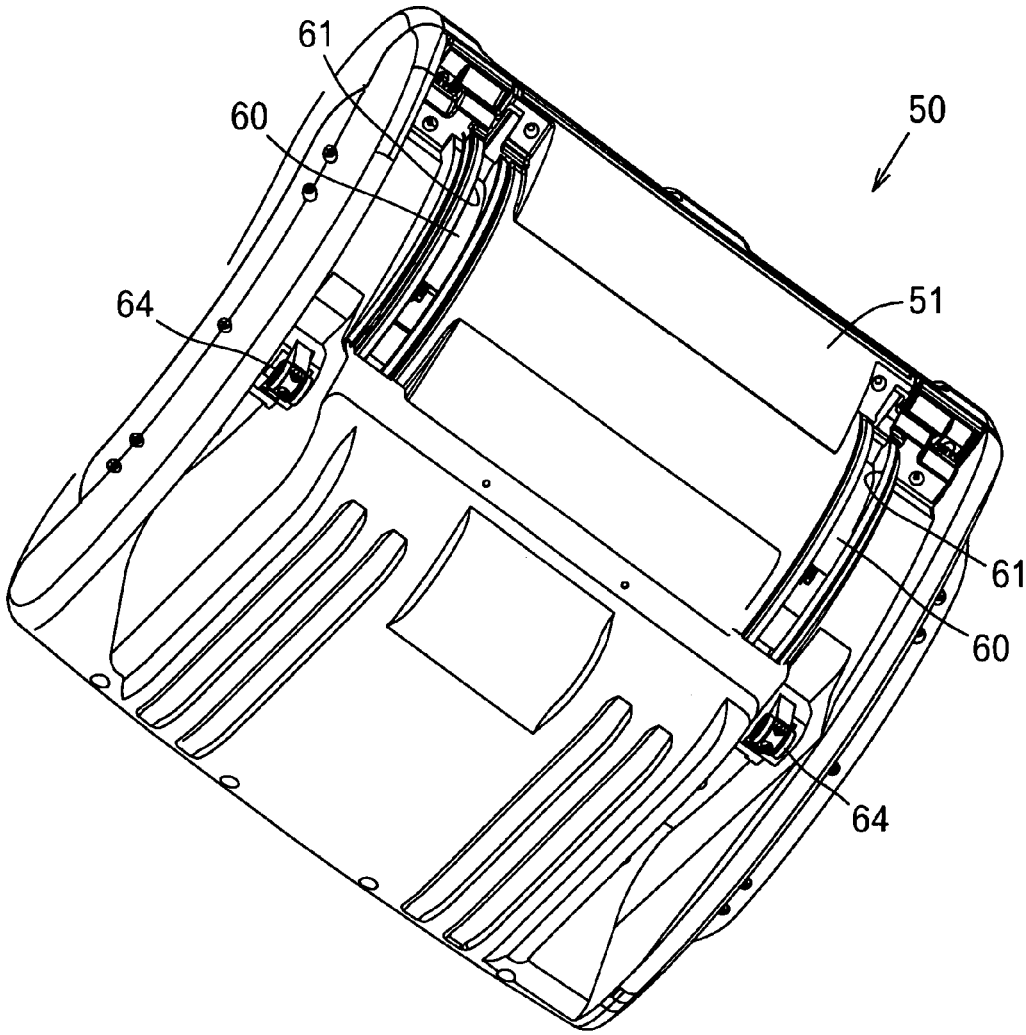
FIG. 6 is a perspective view of the reclining movable assembly as it is seen from below.
Figure 7:
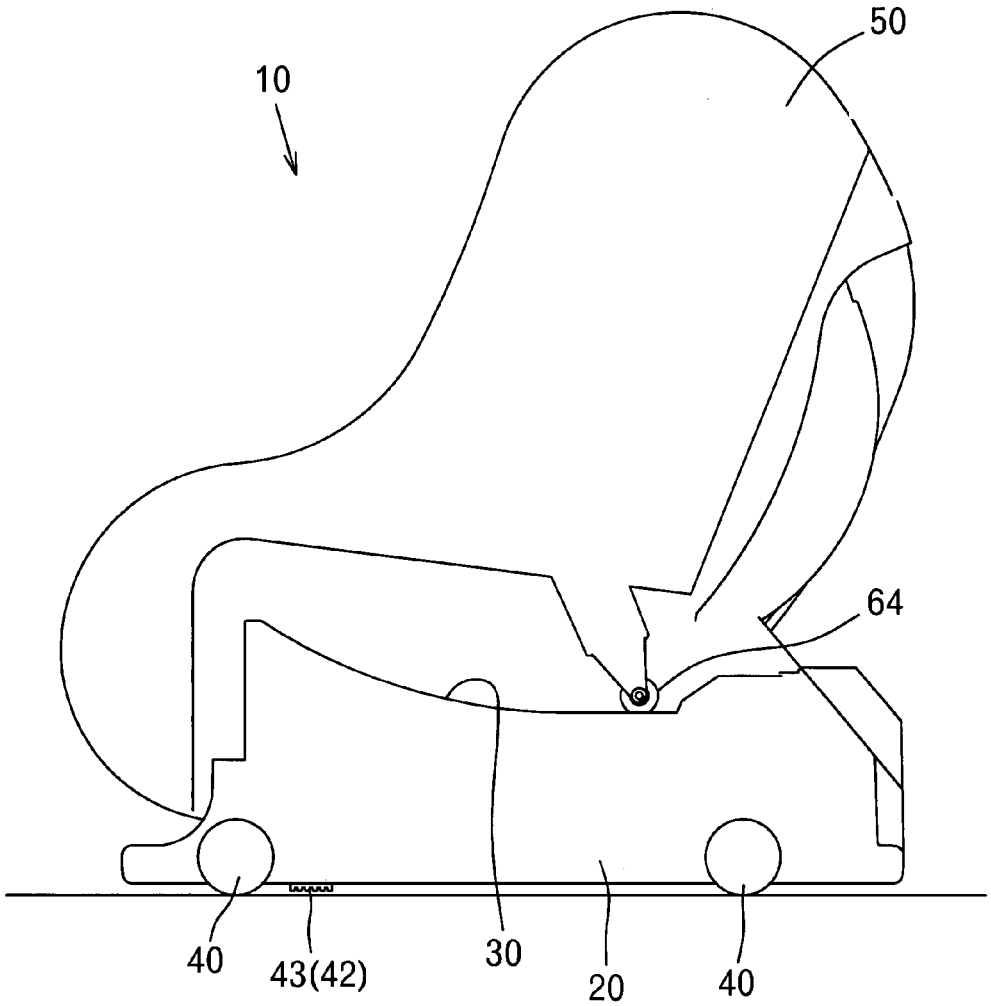
FIG. 7 is a view in section taken along the line Y-Y in FIG. 1 and showing the reclining movable assembly in a raised upright position.
Figure 8:
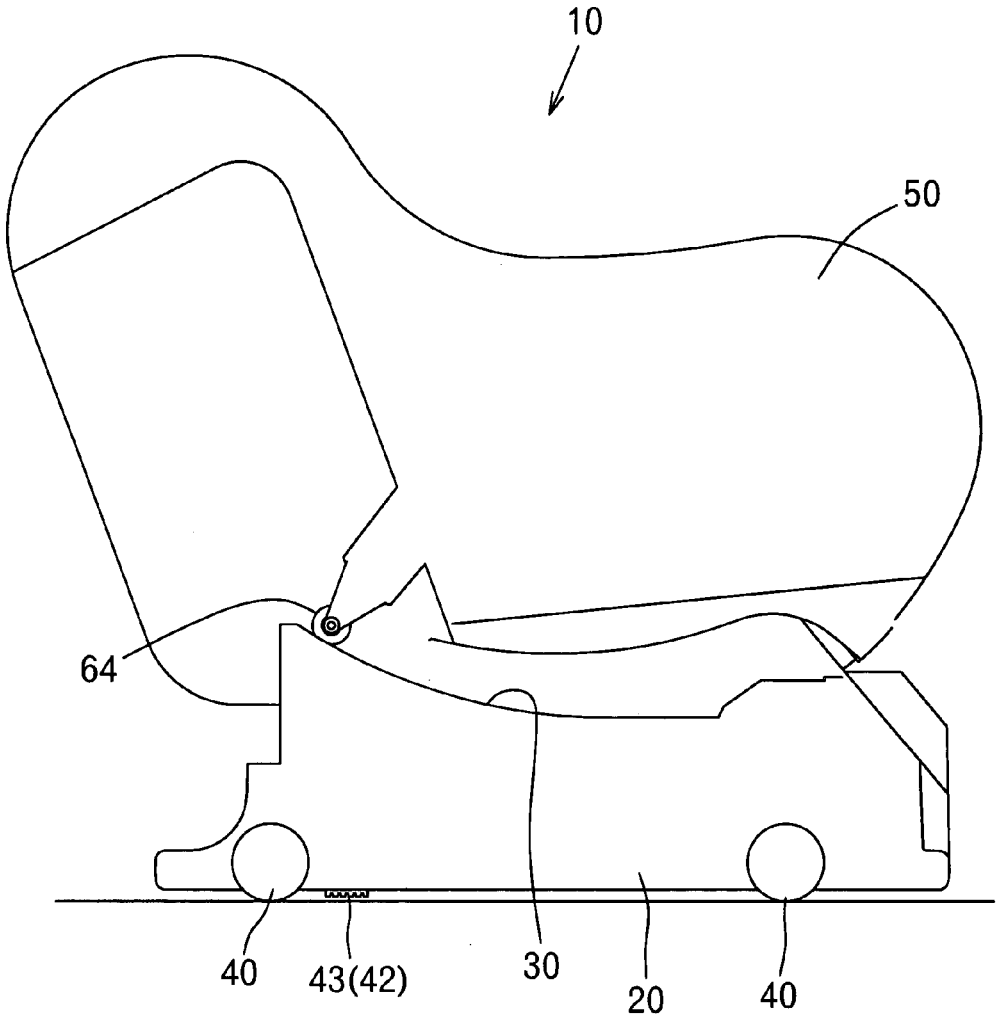
FIG. 8 is a view in section taken along the line Y-Y in FIG. 1 and showing the reclining movable assembly as inclined rearward.
Figure 9:
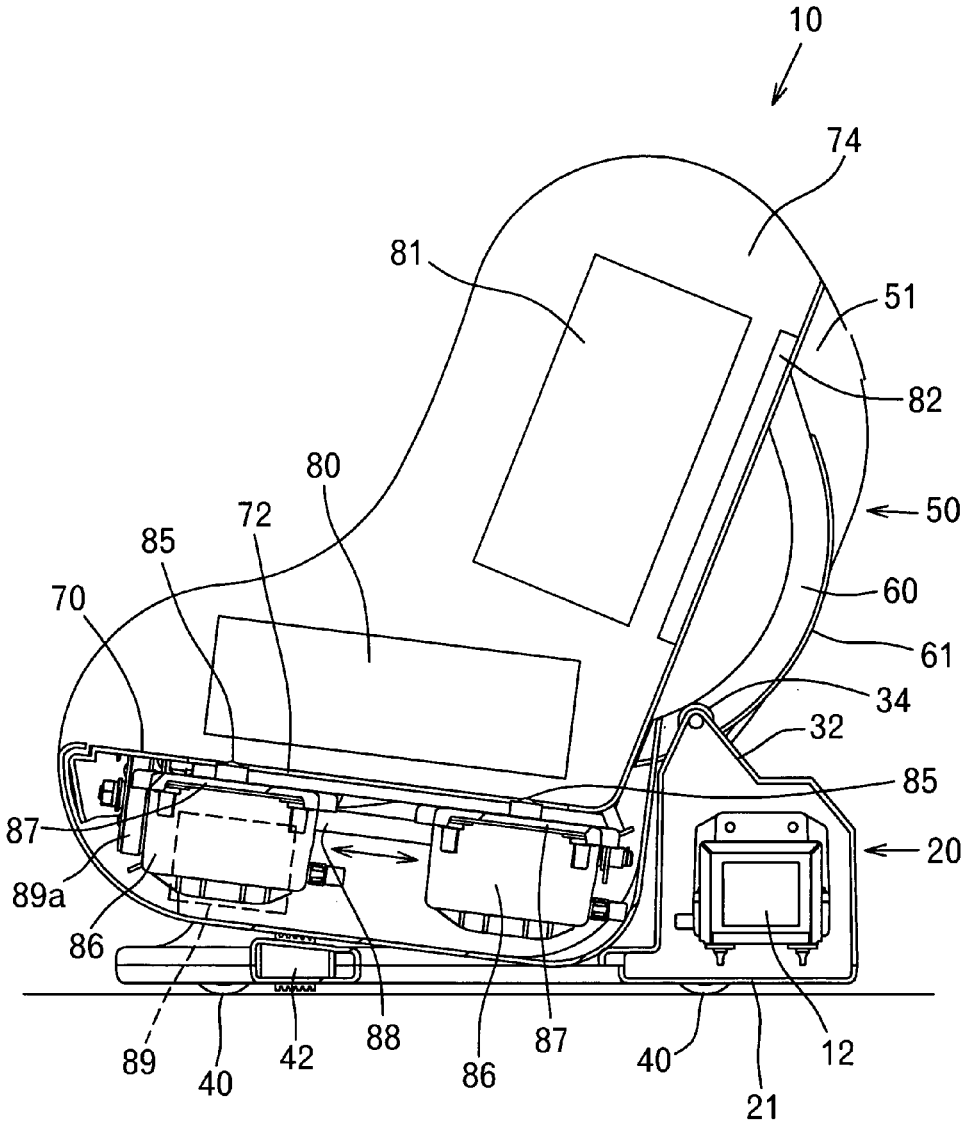
FIG. 9 is a view in section taken along the line Z-Z in FIG. 1 and showing the reclining movable assembly in the raised upright position.
Figure 10:
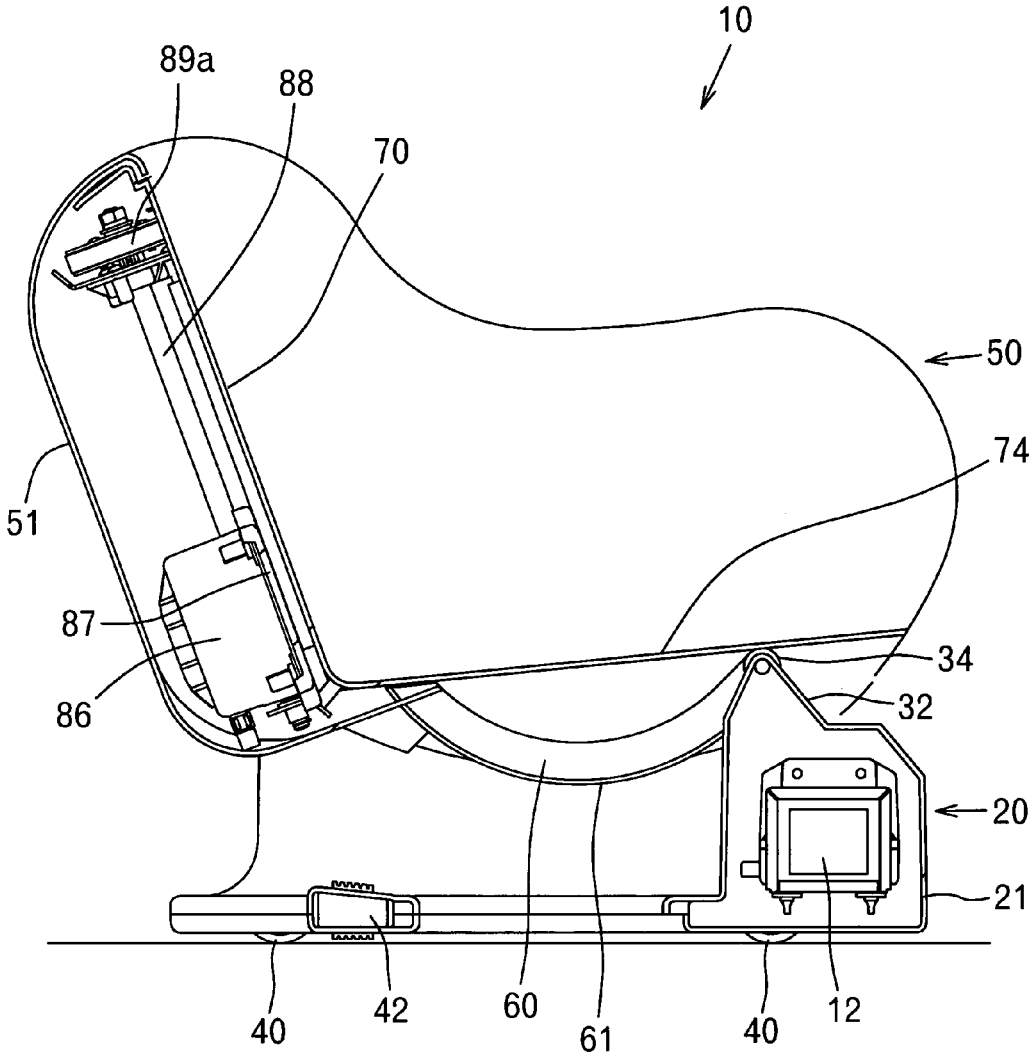
FIG. 10 is a view in section taken along the line Z-Z in FIG. 1 and showing the reclining movable assembly as inclined rearward.

FIG. 1 is a perspective view showing the leg massage machine 10 of the invention as it is seen obliquely from the front, FIG. 2 is a perspective view of the machine to show a reclining movable assembly 50 as inclined rearward and as seen obliquely from the front, FIG. 3 is a perspective view of the machine as it is seen from the bottom side thereof, FIG. 4 is a view in section taken along the line X-X in FIG. 1, FIG. 5 is a perspective view showing a base assembly 20 and the reclining movable assembly 50 as removed therefrom, FIG. 6 is a perspective view of the reclining movable assembly as it is seen from below, FIG. 7 is a view in section taken along the line Y-Y in FIG. 1 and showing the reclining movable assembly 50 in a raised upright position, FIG. 8 is a view in section of the reclining movable assembly 50 as inclined rearward, FIG. 9 is a view in section taken along the line Z-Z in FIG. 1 and showing the reclining movable assembly 50 in the raised upright position, and FIG. 10 is a sectional view of the reclining movable assembly 50 as inclined rearward. FIGS. 7 to 10 are intended to plainly show the shapes of rails 30, 60, with their interior structures omitted or shown schematically.

As shown in these drawings, the leg massage machine 10 comprises a base assembly 20 to be placed on the floor, and a reclining movable assembly 50 supported by the base assembly 20 so as to move rockingly. As will be described later, the reclining movable assembly 50 has recessed receiving portions 70 for the user to insert his or her respective feet thereinto, and leg receiving portions 74 for placing the respective calves thereinto. The recessed receiving portions 70 and the leg receiving portions 74 are each provided with air bags or like known massage means on the side walls and/bottom wall thereof.

The base assembly 20 comprises a hollow resin casing 21. Housed in the interior of the base assembly 20 are an air pump 12 for supplying compressed air to the air bags 80, 81, 82, 83 arranged on the movable assembly 50 and serving as the massage means, a control base panel, a power source unit (not shown).

The base assembly 20 is provided with a pair of opposite rails (hereinafter referred to as "first rails 30, 30") positioned at its right and left top portions, respectively, as shown in FIGS. 4 and 5 and extending forward or rearward. Each of the first rails 30, 30 is curved downward, has a rectangular cross section and is provided with a narrow slot 31, which is formed in the center of the top wall of the rail and extends longitudinally thereof. Rollers (hereinafter referred to as "second rollers 64, 64") on the reclining movable assembly to be described below are rollably fitted to the respective first rails 30, 30.

Each of the first rails 30, 30 needs only to be shaped as curved. For example as shown in FIGS. 7 and 8, the rail 30 can be so shaped as to have a circular-arc forward portion and to become linear as the rail extends rearward. With the rails 30, 30 so shaped, the reclining movable assembly 50, while moving rockingly, is inclined with the center of rocking movement slidingly moving forward, instead of rockingly moving about a fixed support point (phantom support point), enabling the legs of the user to move under no burden.

Incidentally, the first rails 30 may have a circular-arc shape.

As shown in FIGS. 5 and 9, the base assembly 20 is provided at its rear end with a pair of right and left upward brackets 32, 32. Rollers (hereinafter referred to as "first rollers 34, 34") fitting to respective rails (hereinafter referred to as "second rails 60, 60") on the reclining movable assembly 50 to be described later are rollably supported at the upper ends of the brackets 32, 32. The first rollers 34, 34 can be made from a rubber or resin material.

As shown in FIGS. 3 and 4, two furrows 22, 22 are formed in the lower wall of the base assembly 20, and wheels 40, 40 are provided in the furrows 22, 22, rendering the leg massage machine 10 movable forward and rearward along the floor.

The reclining movable assembly 50 comprises a hollow resin casing 51. The casing 51 has a lower portion projecting forward and projects upward at its rear end. The casing 51 has a pair of right and left recessed receiving portions 70, 70 for the user to insert his or her respective feet thereinto, and leg receiving portions 74, 74 extending from the rear ends of the respective receiving portions 70, 70 for the user to place his or her respective calves thereinto as shown, for example, in FIGS. 1 and 4. A center wall 78 is provided between the recessed receiving portions 70, 70 and between the leg receiving portions 74, 74. As will be described later, the recessed receiving portions 70, 70 and the leg receiving portions 74, 74 are provided with massage means for massaging the user.

As shown in FIGS. 5, 6 and 9, the first rollers 34, 34 on the base assembly 20 are fittable to the second rails 60, 60 which are provided at opposite sides of the rear end of the reclining movable assembly 50. Each of the second rails 60 is curved to bulge rearward, rectangular in cross section and provided with a narrow slot 61, which is formed in the rear wall of the rail 60 and extends longitudinally thereof.

The second rails 60, 60 need only to be curved in shape, and are in a circular-arc shape according to the illustrated embodiment. When to be in the circular-arc shape, the rails are preferably about 90 to 120 degrees in the angle of circular arc. The second rails 60 may have the same curved form as the first rails 30 on the base assembly 20, or may be made different therefrom in curvature, length or angle of circular arc.

The second rollers 64, 64 fittable to the respective first rails 30, 30 on the base assembly 20 are rollably supported by opposite sides of midportion, with respect to the front-rear direction, of the reclining movable assembly 50. The second rollers 64, 64 can be made from a rubber or resin material.

The recessed receiving portions 70, 70 and the leg receiving portions 74, 74 are provided with massage means on their side walls and bottom walls. According to the present embodiment, the massage means are finger pressure members 85, 85 provided on the bottom walls of the recessed receiving portions 70, 70, and air bags 80, 81, 82 provided on the side walls of the receiving portions 70, 70, and on the side walls and bottom walls of the leg receiving portions 74, 74 as seen in FIG. 9. The air bags 80, 81, 82 serving as massage means are shown only in FIG. 9.

With reference to FIGS. 9 and 17 to 19, each finger pressure member 85 is projectable from and retractable into a slit 72 formed in the bottom wall of the recessed receiving portion 70 and elongated in the front-rear direction, and is movable forward and rearward along the slit 72. Stated more specifically with reference to FIGS. 17 to 19 to be described below, the finger pressure member 85 is connected at its lower end to an air bag 83, which is housed in a case 86. Right and left cases 86 corresponding to the finger pressure members 85, 85 in the right and left recessed receiving portions 70, 70 are connected by a connecting plate 87, the center portion of which is connected by a screw sleeve (not shown) to a screw rod 88 supported by, and extending forward or rearward in parallel to, the bottom wall of the recessed receiving portions 70. The screw rod 88 is connected to a motor 89 (see FIG. 9) via a reduction gear mechanism. 89*a*. When rotated, the screw rod 88 moves the connecting plate 87 forward and rearward, moving the pressure members 85 along the slits 72. The finger pressure members 85 are shown as moved to the foremost position or rearmost position in FIGS. 9, 17 to 19 and in FIGS. 24 and 25 to be described later.

The motor 89 can be disposed under the center wall 78. To position the center of gravity of the reclining movable assembly 50 toward the front, it is desired that the motor 89 be disposed at a forward portion of the reclining movable assembly 50 as shown in FIG. 9.

Further to position the center of gravity of the reclining movable assembly 50 toward the front, it is also desirable that the case 86 accommodating the finger pressure member 85 be adapted to stop as moved to the foremost portion of the recessed receiving portion 70 when the power source is turned off.

Figure 11:
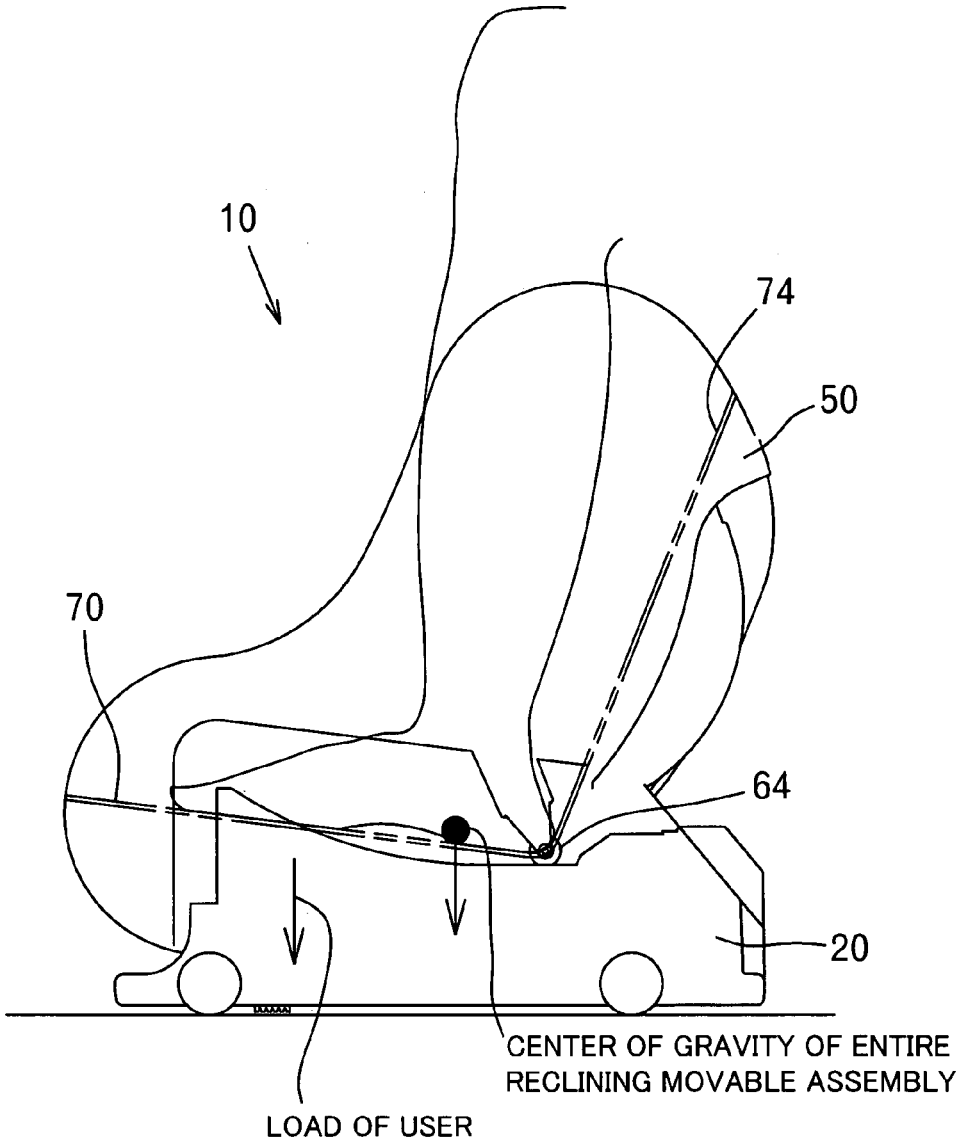
FIG. 11 is a diagram for illustrating the load of the user acting on the reclining movable assembly when the user stands up and the position of the center of gravity of the entire reclining movable assembly.

In order to prevent the reclining movable assembly 50 from wobbling when the user stands up with his or her soles bearing on the recessed receiving portions 70, it is desirable to make such adjustment that with the load of the user acting on the recessed receiving portions 70, the center of gravity of the entire reclining movable portion 50 will be positioned to the front of the second rollers 64 as shown in FIG. 11.

When the user stands up with his or her soles bearing on the recessed receiving portions 70, the load of the user concentrates on the tips of the toes as shown in FIG. 11, so that the center of gravity of the entire assembly 50 will be positioned to the front of the second roller 64 serving as the support point as illustrated. This obviates the likelihood that the reclining movable assembly 50 will rotate rearward. Thus, even if the user stands up on the recessed receiving portions 70, the movable assembly 50 is brought to the most raised upright position without wobbling.

The air bags 80, 81, 82 provided for the recessed receiving portions 70, 70 and the leg receiving portions 74, 74 on opposite sides, and the air bags 83 for moving the finger pressure members 85 to the projected position or retracted position are connected to respective pipes, which extend into the casing 51 of the reclining movable assembly 50. The pipes are provided with respective electromagnetic valves, and the piping system extends into the base assembly 20 and is connected to the air pump 12. The pipe portions upstream from the valves are preferably combined into a single pipe or some pipes for connection to the air pump 12, whereby the number of pipes connecting the movable assembly 50 to the base assembly can be diminished.

Preferably, the electromagnetic valve is so disposed that the plunger thereof will be reciprocatingly movable perpendicular to the direction of rocking movement of the reclining movable assembly 50 horizontally with respect to the floor. By making the plunger reciprocatingly movable in the above direction, the erroneous operation or malfunction of the valve is avoidable even if the valve is inclined by the rocking movement of the movable assembly 50.

The electromagnetic valves can be provided alternatively in the base assembly 20.

Figure 12:
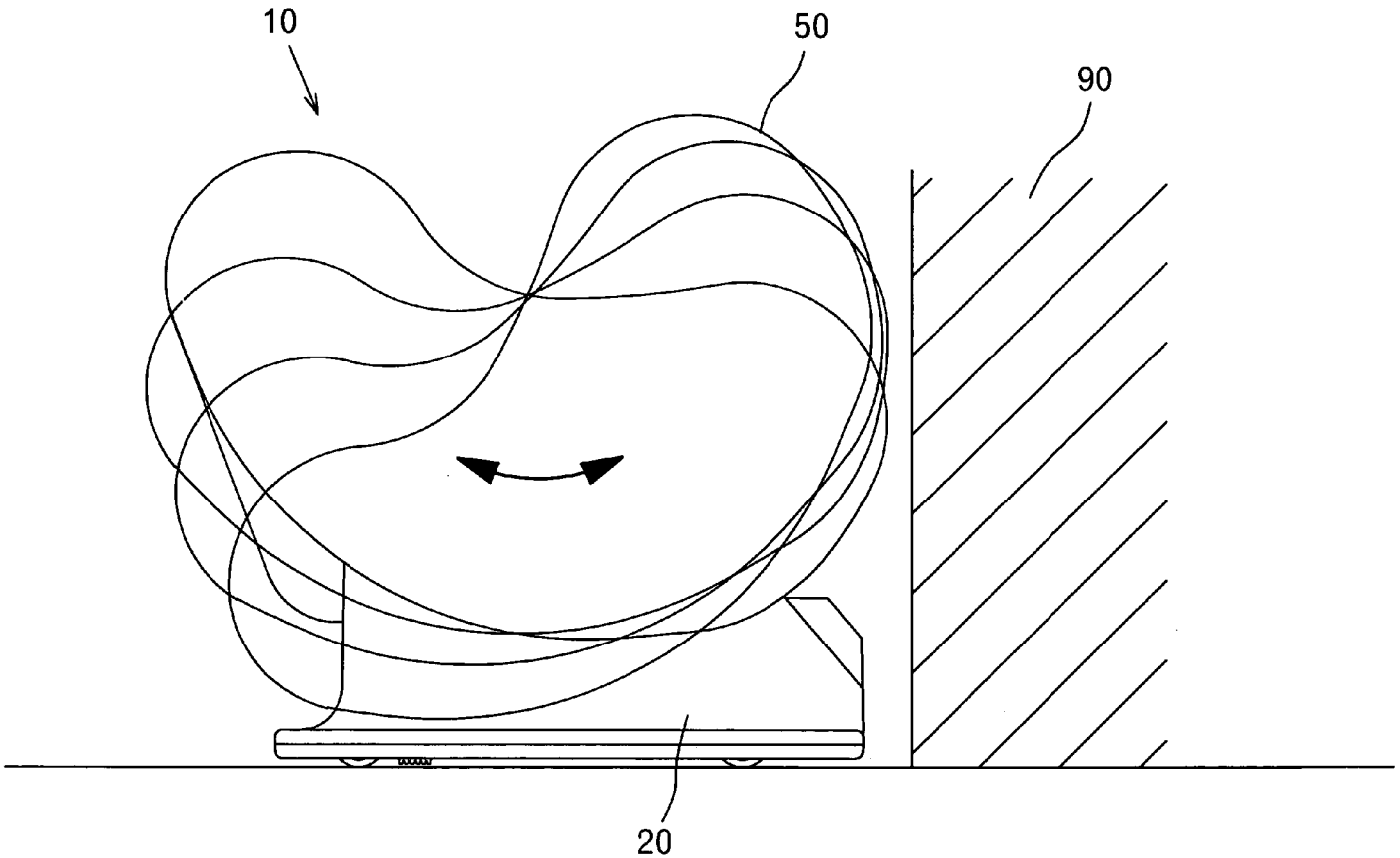
FIG. 12 is a side elevation showing the path of movement of the reclining movable assembly when it is moved rockingly.

With the leg massage machine 10 of the invention described, the reclining movable assembly 50 is made rockingly movable relative to the base assembly 20 by the curved first rails 30, 30 and second rails 60, 60. Accordingly, if the user is seated in a chair or lies down on the floor with his or her feet inserted in the recessed receiving portions 70 and the calves placed in the leg receiving portions 74, the calves shift in angle, rockingly moving the movable assembly 50 as shown in FIG. 12. With first rails 30, 30 and the second rails 60, 60 so shaped as shown in FIGS. 7 and 9, the reclining movable assembly 50 will not move rearward easily as shown in FIG. 12 during the rocking movement. Especially, the rear side of the massage machine 10 will not be projected by the rocking movement of the movable assembly 50, so that the assembly 50 can be rocked for massaging without coming into striking contact with a chair or like obstacle which may be positioned in the rear of the machine.

Figure 13:
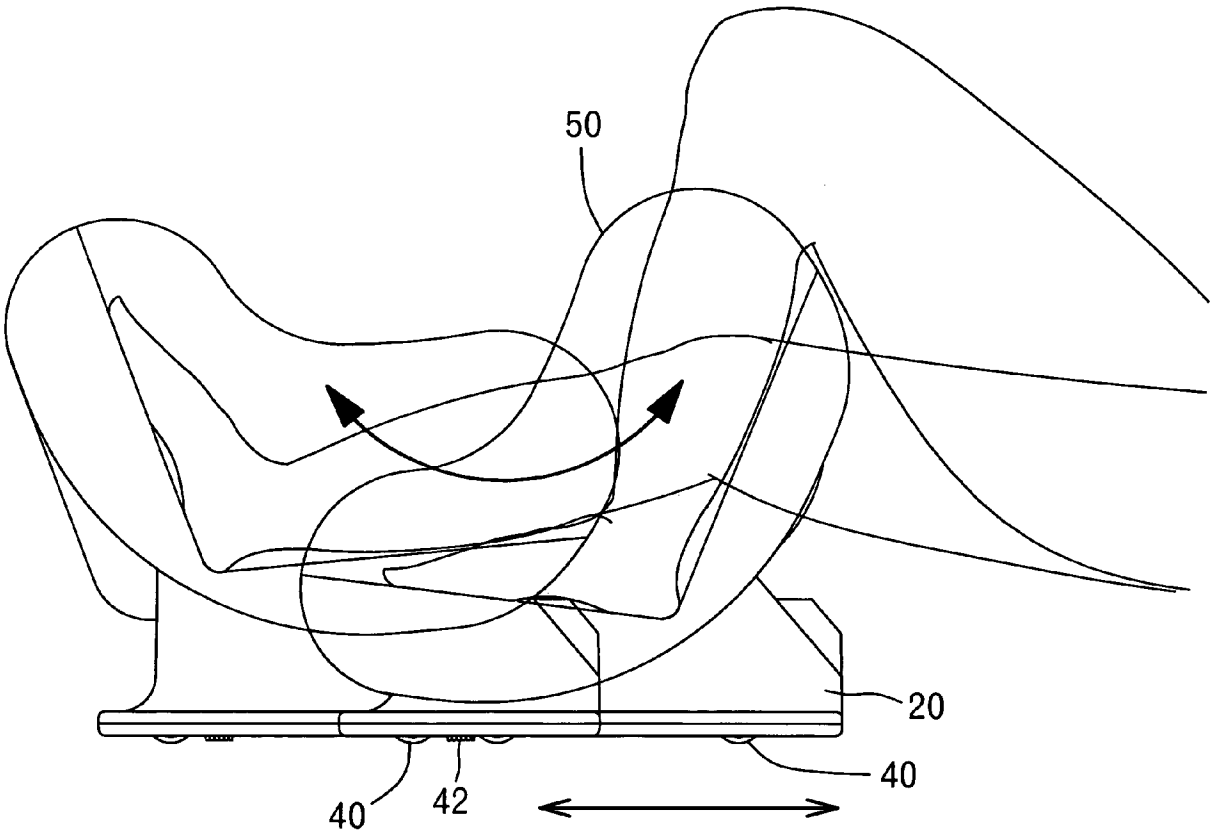
FIG. 13 is a diagram for illustrating the reclining movable assembly as moved rockingly and the base assembly as moved forward and backward, with the legs of the user inserted in the movable assembly.

If the user lying down with his legs flexed inserts his legs into the reclining movable assembly 50 and then stretches his legs, the assembly 50 is inclined rearward, and the machine 10 itself is pushed forward by the legs as shown in FIG. 13 since the wheels 40, 40 are provided on the base assembly 20. Accordingly, the user need not adjust the position of the leg massage machine 10 before inserting his legs and can therefore be given a massage by the machine at the desired angle in the desired position.

It is desired that the reclining movable assembly 50 be held in the raised upright position while the user's legs are not inserted thereinto, enabling the user to place his legs into the machine easily. However, if the reclining movable assembly 50 as inclined rearward is forcibly biased toward the raised upright position, the legs must be thrust out in the rearward inclining direction always when the assembly 50 is inclined rearward by inserting the legs thereinto. This is not desirable in view of the effect of massage.

Figure 14:
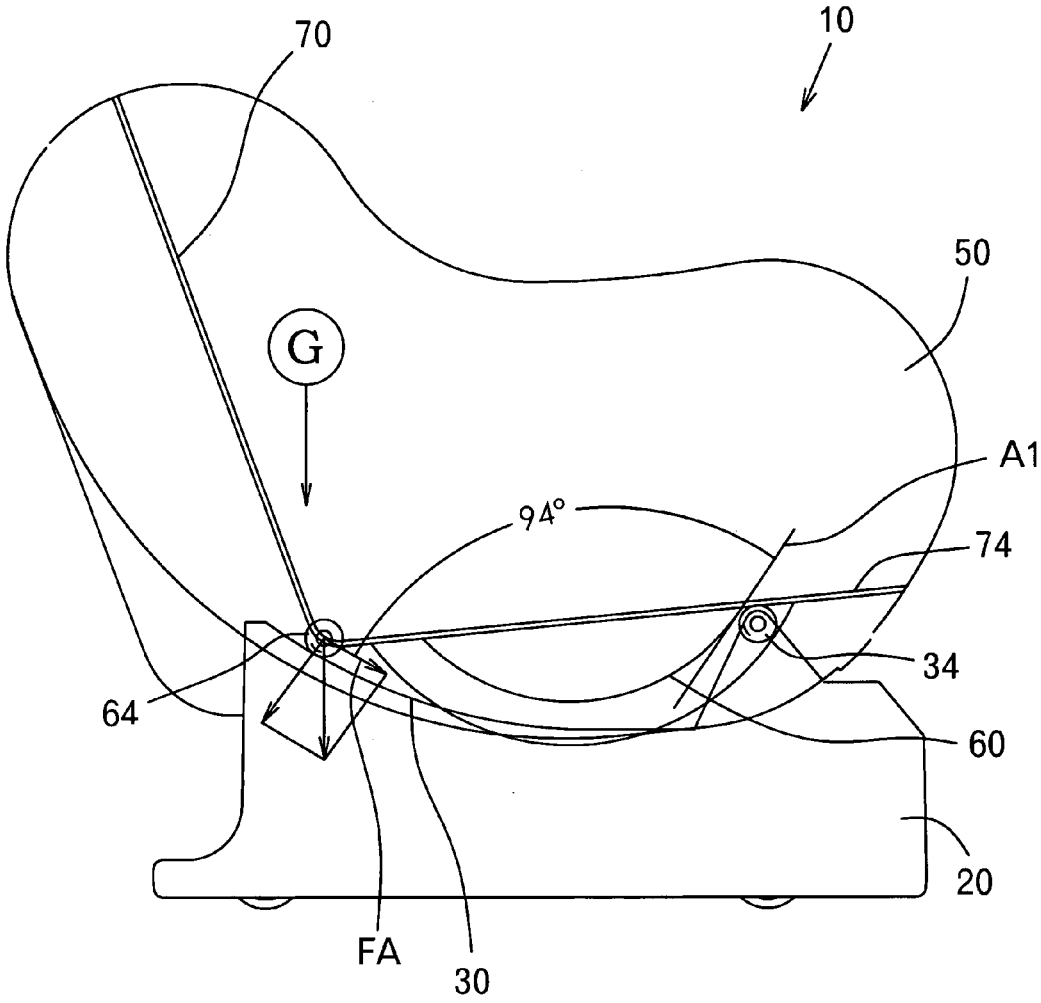
FIG. 14 is a diagram for illustrating the position of the center of gravity when the reclining movable assembly is moved rockingly.

Accordingly, the reclining movable assembly 50 as inclined rearward can be given enhanced stability by so adjusting the assembly 50 that the center of gravity G thereof will be positioned toward the front (to the front of the center of rocking movement serving as a phantom support point for the rocking movement) and that the center of gravity G of the assembly 50 as inclined rearward will be positioned approximately immediately above the second roller 64 provided on the assembly 50 as shown in FIG. 14.

Figure 15:
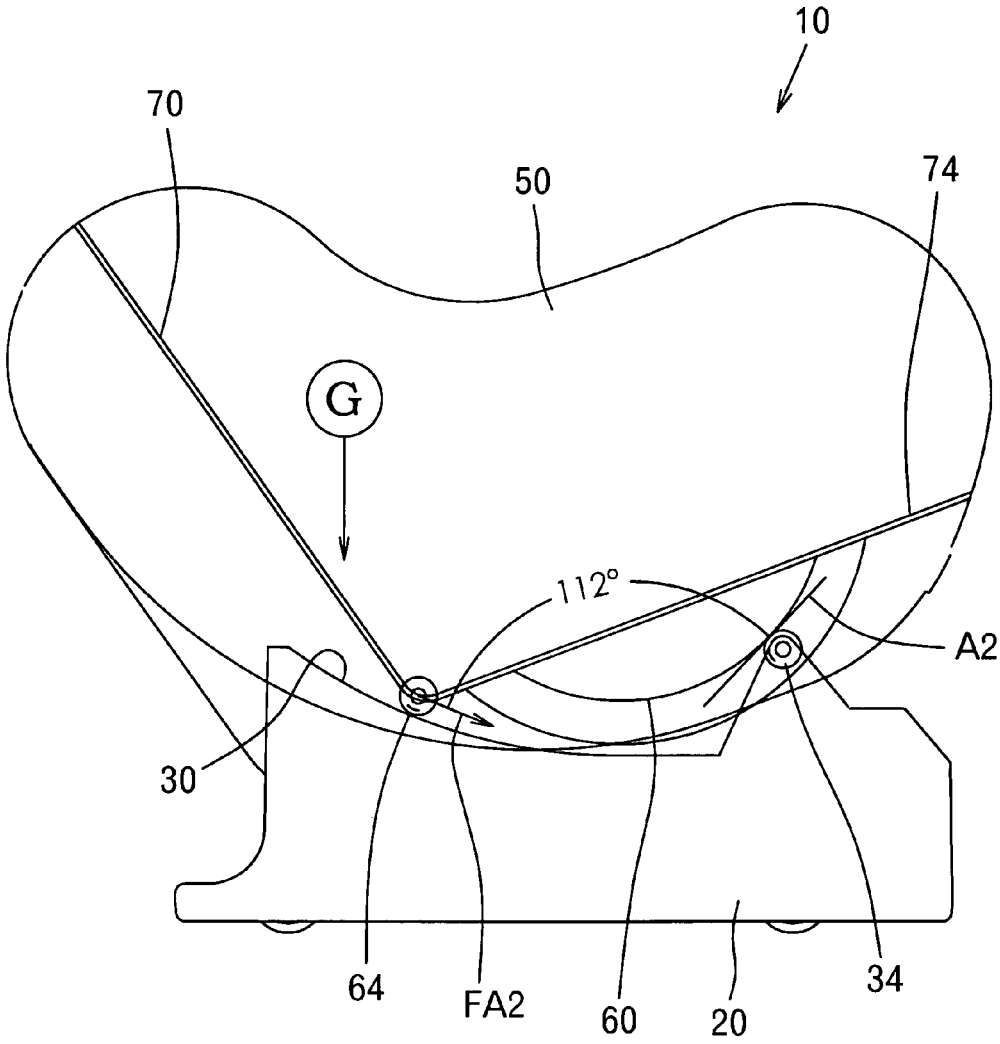
FIG. 15 is a diagram for illustrating the position of the center of gravity when the reclining movable assembly is moved rockingly.
Figure 16:
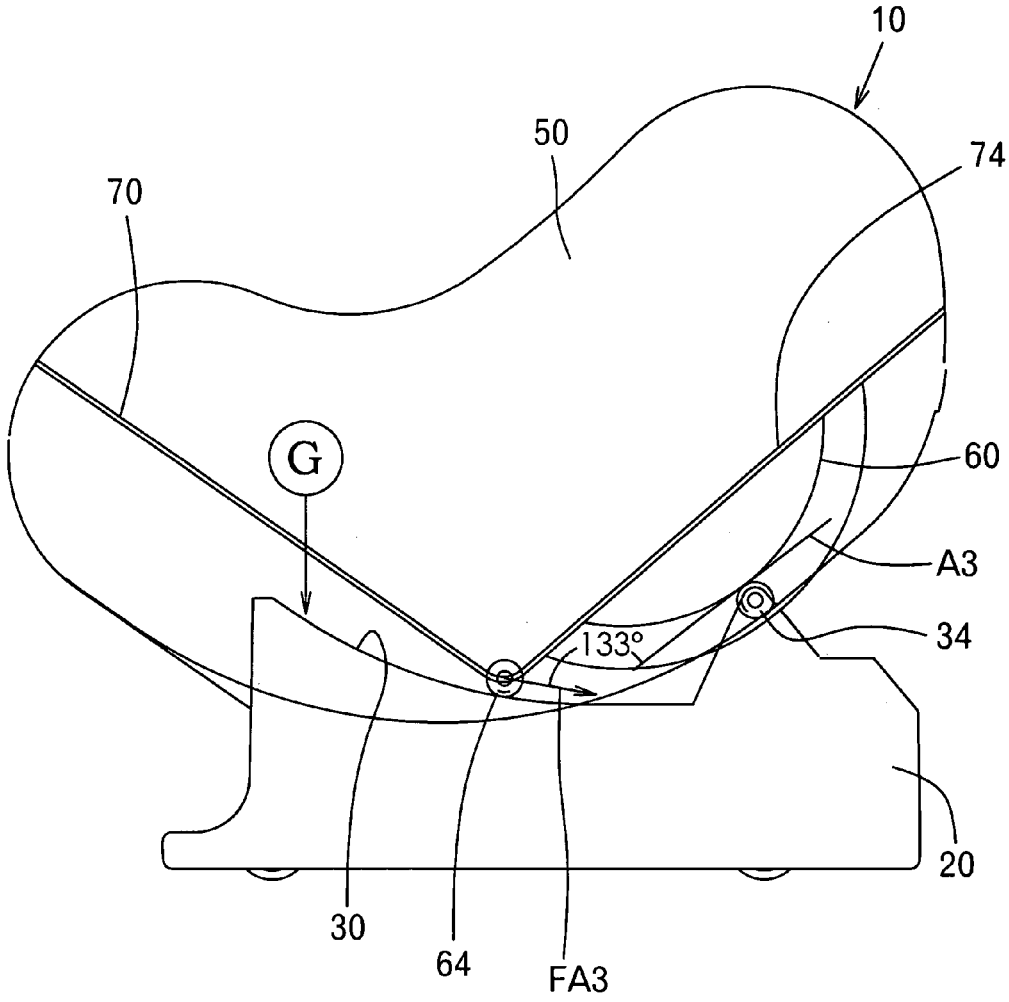
FIG. 16 is a diagram for illustrating the position of the center of gravity when the reclining movable assembly is moved rockingly.

A detailed description will be given with reference to FIG. 14 showing the assembly 50 as inclined most rearward. The plane A1 of contact of the first roller 34 with the second rail 60 makes an approximate right angle (94 degrees in the drawing) with a force FA acting on the second roller 64 to urge the assembly toward the raised upright position, so that increased resistance is offered to the component FA to hold the assembly 50 at rest. When the reclining movable assembly 50 is slightly raised toward the upright position, the angle of the plane A2 of contact of the first roller 34 with the second rail 60 with the force FA2 acting to raise the assembly 50 increases, and the center of gravity G is positioned to the front of the second roller 64 as shown in FIG. 15, so that the assembly 50 is forced toward the raised upright position. The angle of the plane A3 of contact of the first roller 34 with the second rail 60 with the force FA3 acting to raise the assembly 50 further increases as shown in FIG. 16, the resistance to the force FA3 decreases, and the center of gravity G is brought further closer to the front than in the case of FIG. 15. The assembly 50 can therefore be made to rise toward the upright position under gravity.

Although the reclining movable assembly 50 is thus adapted to rise to the upright position by itself by virtue of the position of gravity and the relationship between the rails 30, 60 and the rollers 34, 64 with respect to position and contact angle, the assembly 50 may be biased by elastic means such as rubber. In this case, the reclining movable assembly 50 is subjected to a biasing force toward the raised upright position, with a snap action mechanism provided for the assembly 50 so that the assembly is released from the biasing force when inclined most rearward.

With reference to FIGS. 3 and 4, the wheels 40, 40 arranged on the base assembly 20 are suitable for adjusting the position of the leg massage machine 10 and the angle of the assembly 50 when the user is to be massaged, However, the wheels 40, 40 will roll along and move the massage machine 10 when the user as seated in a chair places his legs into the machine 10 for massaging, or if the user stands up on the recessed receiving portions 70 of the assembly 50 to remove the legs from the machine 10 upon completion of massage.

It is therefore desired that the base assembly 20 be provided with brake means 42 for preventing the assembly 20 from moving forward or rearward. More preferably, the brake means 42 is adapted to act only when a load of not smaller than a predetermined value acts on the leg massage machine 10.

Figure 17:
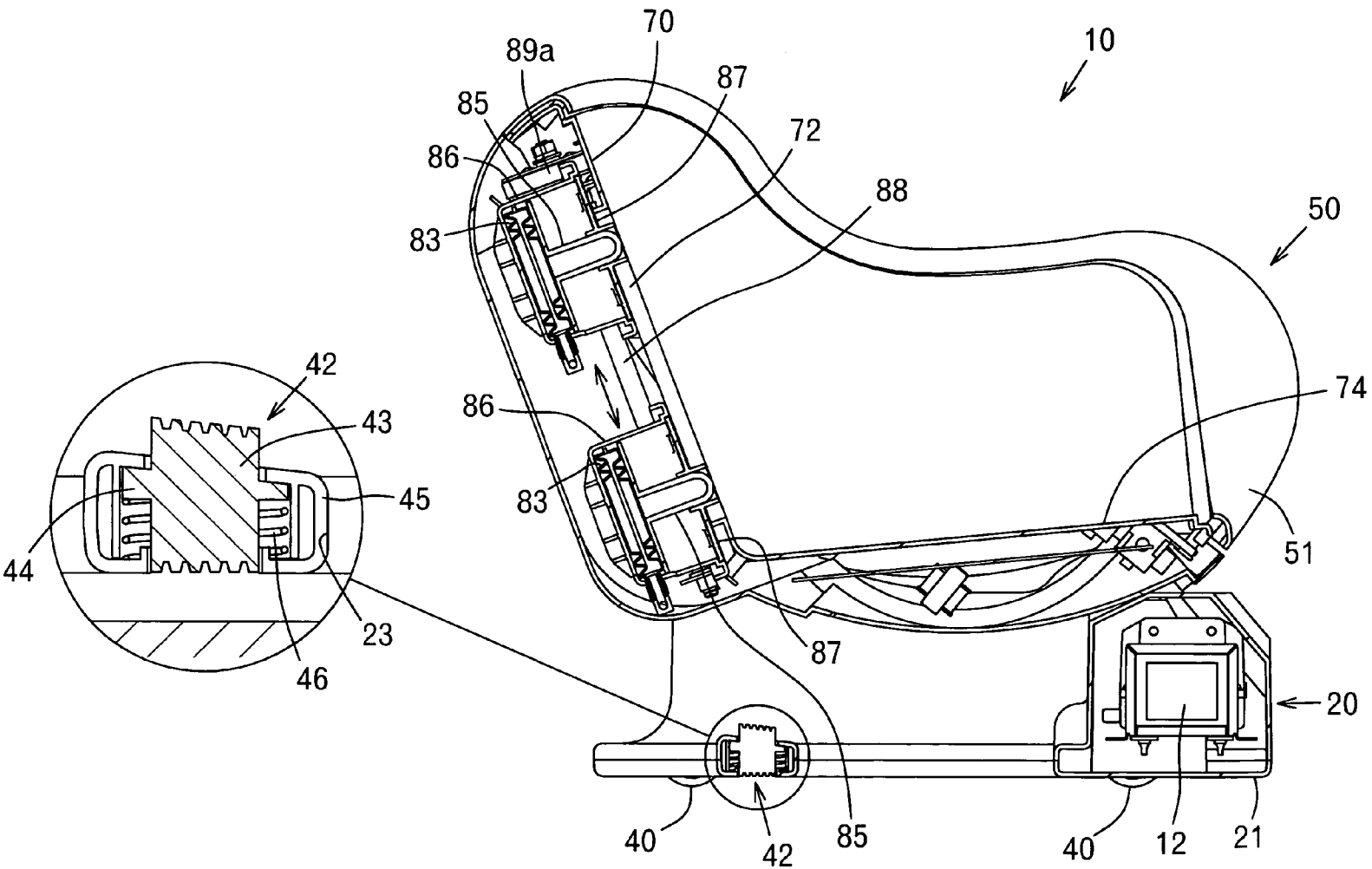
FIG. 17 is a sectional view of the leg massage machine to show brake means.
Figure 18:
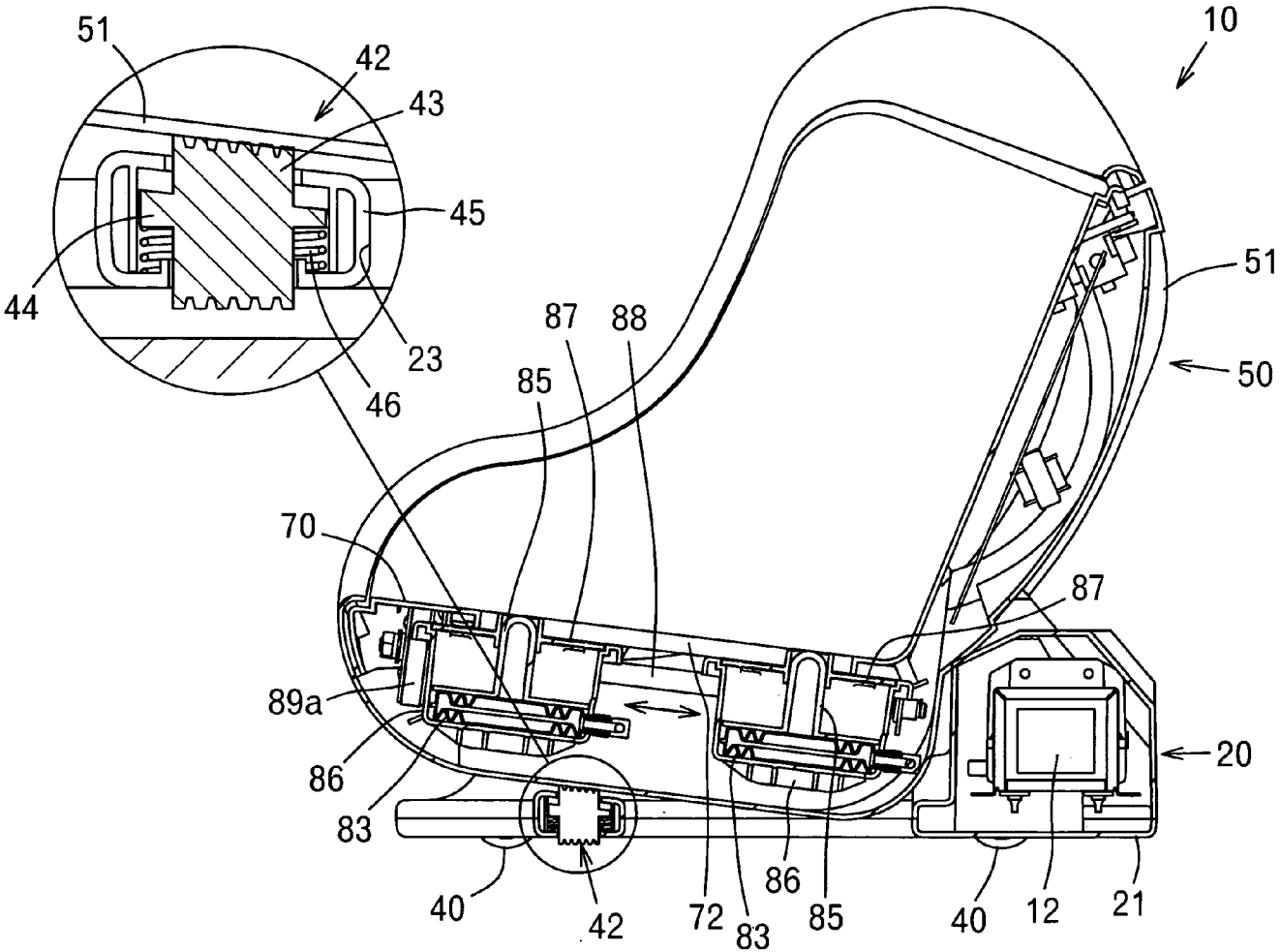
FIG. 18 is a sectional view of the leg massage machine to show the brake means.
Figure 19:
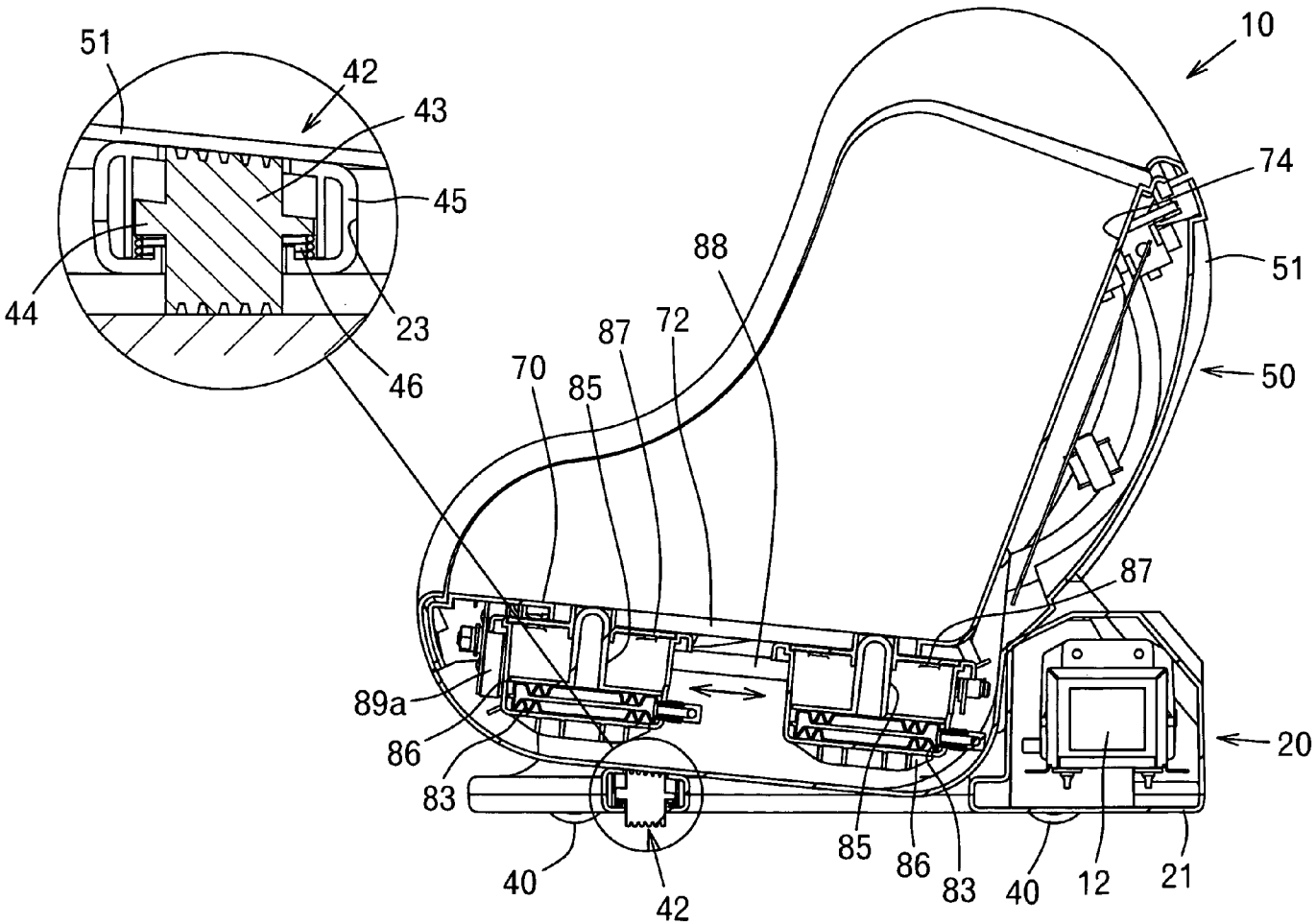
FIG. 19 is a sectional view of the leg massage machine to show the brake means.
Figure 20:
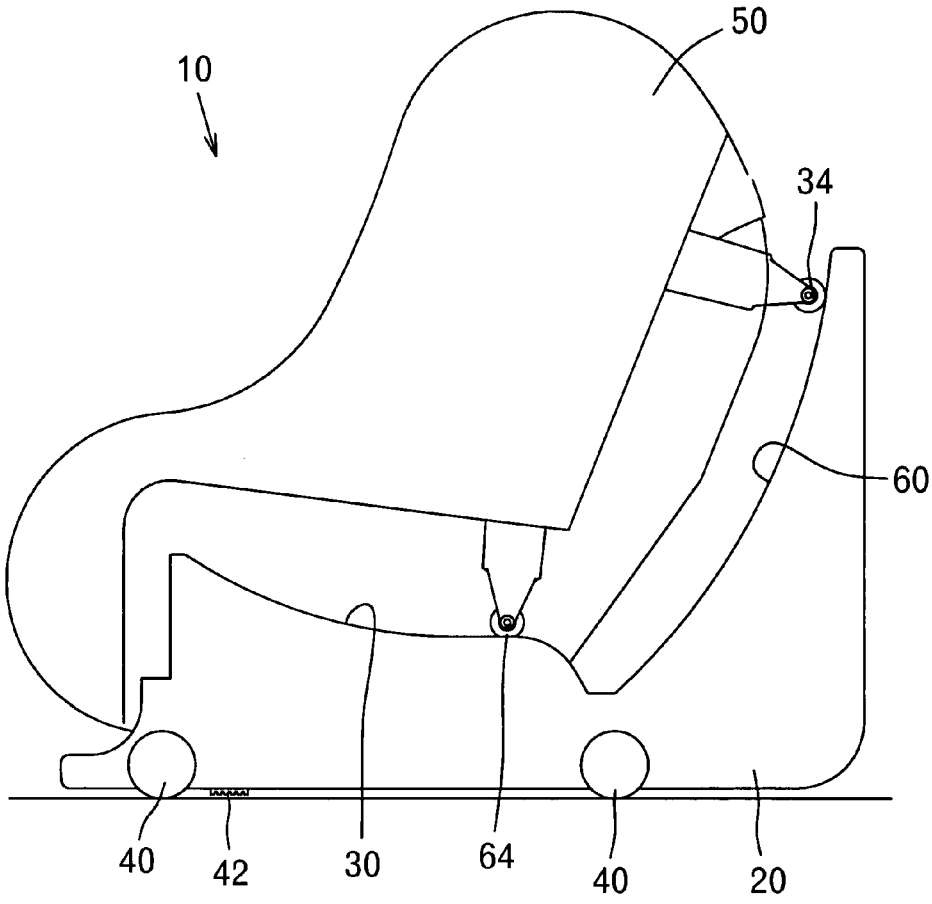
FIG. 20 is a diagram for illustrating an embodiment wherein rails are provided on a base assembly and rollers on a reclining movable assembly.
Figure 21:
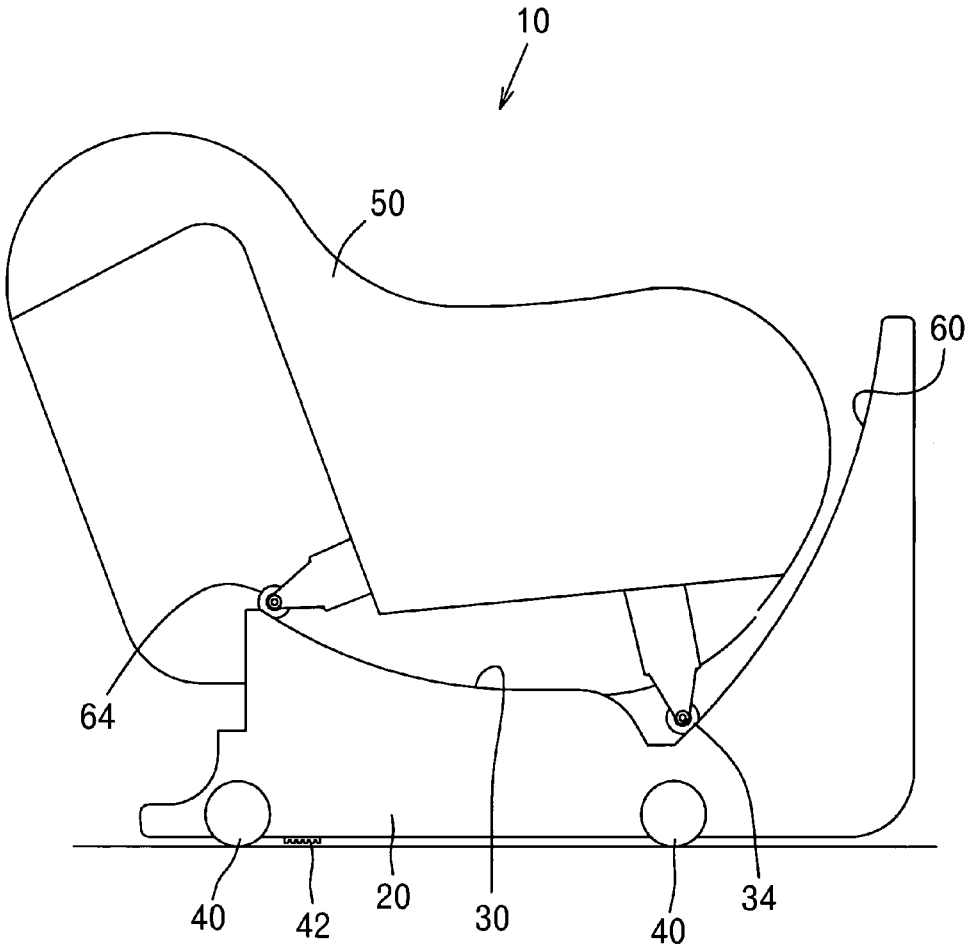
FIG. 21 is a diagram for illustrating the embodiment having the rails and the rollers on the base assembly and the reclining movable assembly, respectively.

FIGS. 17 to 19 show an example of brake means 42 which acts only when the reclining movable assembly 50 is brought to the most raised upright position. The illustrated brake means 42 is provided in a through hole 23 formed in the base assembly 20. The brake means 42 has a brake member 43 made of rubber or like material which will not slip on the floor easily.

The brake member 43 can be, for example, a solid cylindrical member. The brake member 43 has an upper end face extending to a lower level toward the rear end thereof in conformity with the slope of the casing 51 of the reclining movable assembly 50 so as to effectively come into contact with the assembly 50 in the raised upright position, and a lower end face in parallel to the floor so as to obtain the greatest braking effect upon coming into contact with the floor. The upper end and the lower end of the brake member 43 have many indentations or projections for the prevention of slipping.

The brake member 43 is provided with a flange 44 around its periphery. The brake member 43 is placed in a case 45 from which the upper and lower ends of the member 43 are retractably projectable. Disposed inside the case 45 is a coil spring or like biasing means 46 for biasing the brake member 43 upward. The flange 44 of the brake member 43 is biased upward by the biasing means 46. The case 45 is disposed in the through hole 23.

When the reclining movable assembly 50 is inclined rearward, the brake member 43 of the brake means 42 thus constructed has its lower end retracted into the case 45 by the biasing force of the biasing means 45 as seen in FIG. 17, whereas when the assembly 50 is raised to its upright position, the lower wall of casing 51 of the assembly 50 comes into bearing contact with the upper end of the brake member 43 as shown in FIG. 18. When the assembly 50 is brought to the most raised upright position and subjected to a load of not smaller than a predetermined value as when the user stands up on the recessed receiving portions 70 of the assembly 50, the brake member 43 is pressed by the lower wall of casing 51 of the assembly 50 against the biasing force of the means 46, whereby the lower end of the member 43 is pressed into contact with the floor for braking.

This obviates the likelihood that when the user stands up on the recessed receiving portions 70, the wheels 40, 40 will move the leg massage machine 10 forward or rearward, consequently preventing the machine from tumbling.

Embodiment 2

According to the foregoing embodiment, the first rails 30 are provided on the base assembly 20, and the second rails 60 on the reclining movable assembly 50, whereas the base assembly 20 may be provided with first rails 30 and second rails 60, and the movable assembly 50 with first rollers 34 and second rollers 64. Of course, the reclining movable assembly 50 can be provided with first rails 30 and second rails 60, and the base assembly 20 with first rollers 34 and second rollers 64.

Embodiment 3

Figure 22:
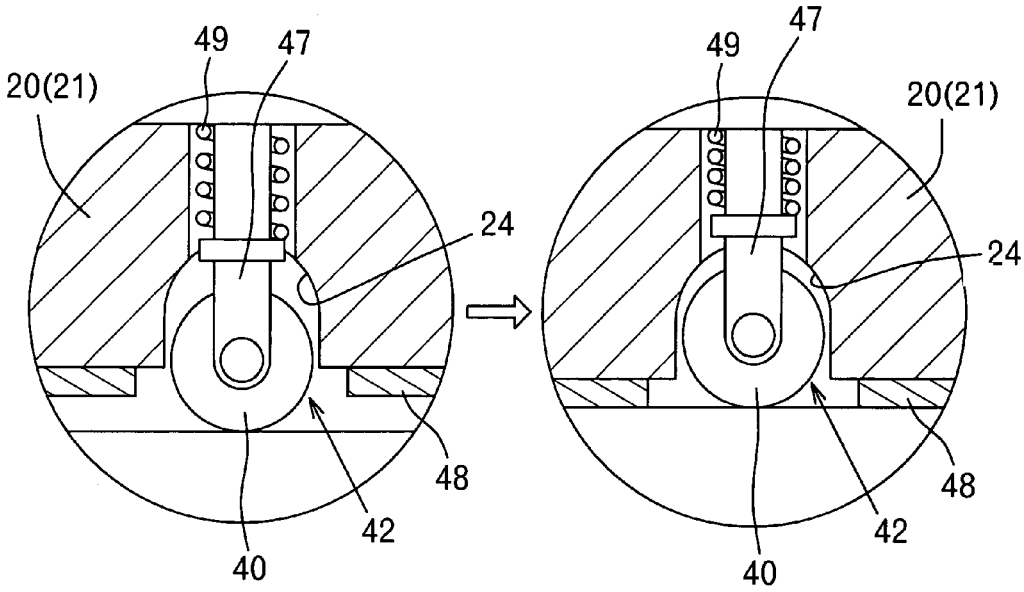
FIG. 22 is a sectional view showing another embodiment having different brake means.
Figure 23:
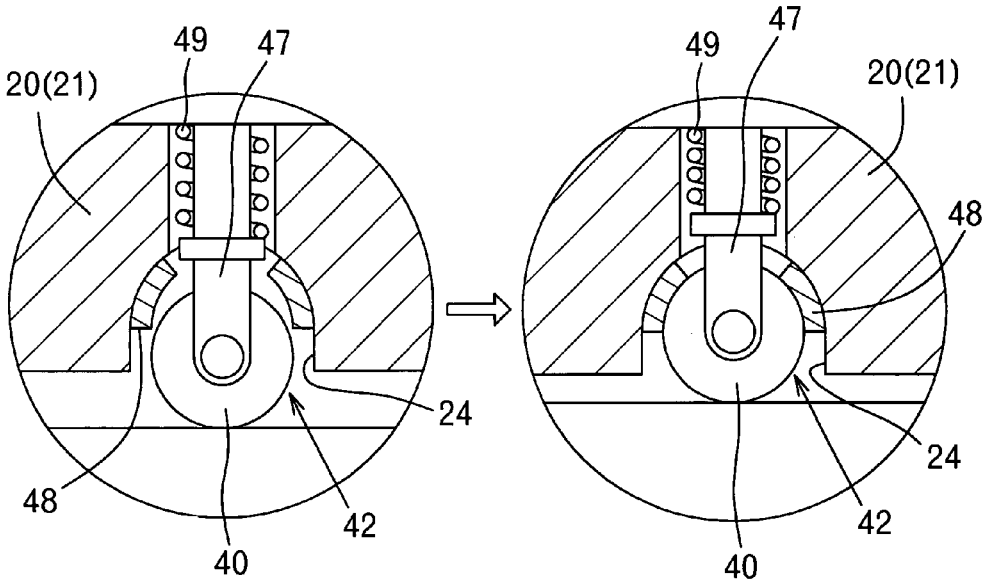
FIG. 23 is a sectional view showing another embodiment having different brake means.

FIGS. 22 and 23 show different embodiments of brake means 42.

The brake means 42 shown in FIG. 22 has a cavity portion 24 to be provided with a wheel rod 47 and formed in the lower wall of the base assembly 20, and a wheel 40 is made projectable from and retractable into the cavity portion 24. The wheel rod 47 is slidable upward or downward, and the wheel 40 attached to the rod 47 is biased downward by a coil spring or like biasing means 49. Rubber or like nonslip means 48 is attached to the lower wall of the base assembly 20. When a load of not smaller than a predetermined value acts on the base assembly 20, the base assembly 20 moves down against the biasing means 49, forcing the wheel 40 into the cavity portion 24 and bringing the nonslip means 48 into contact with the floor, whereby the base assembly 20 is braked.

The brake means 42 shown in FIG. 23 comprises nonslip means 48 provided on the side wall defining a cavity portion 24 for accommodating a wheel 40. When a load of not smaller than a predetermined value acts on the base assembly 20, the base assembly 20 moves down against the biasing force of biasing means 49, forcing the wheel 40 into the cavity 24 and bringing the wheel into contact with the nonslip means 48. This renders the wheel 40 nonrotatable to brake the base assembly 20.

Embodiment 4

Figure 24:
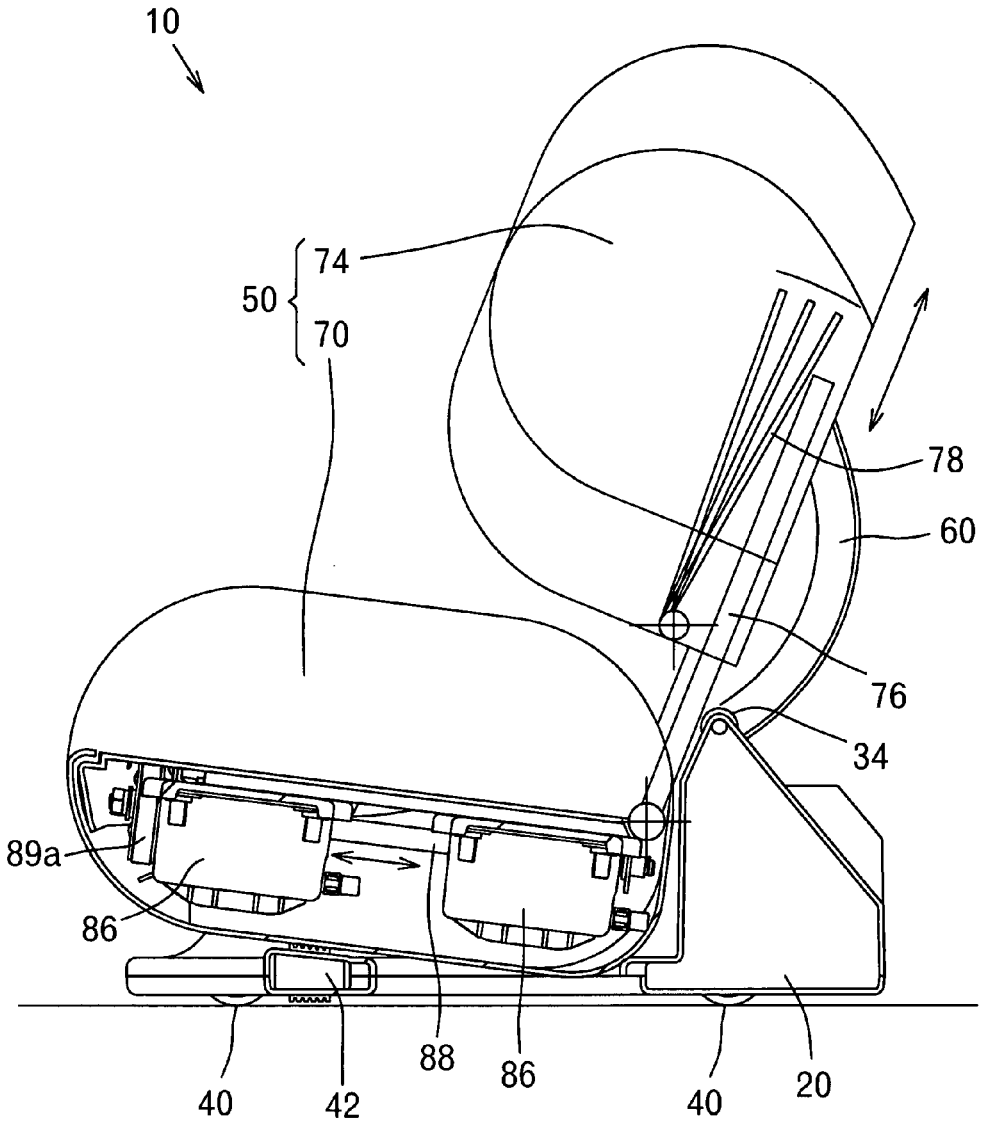
FIG. 24 is a sectional view of a leg massage machine wherein leg receiving portions are provided upwardly and downwardly slidably and tiltably relative to recessed receiving portions.
Figure 25:
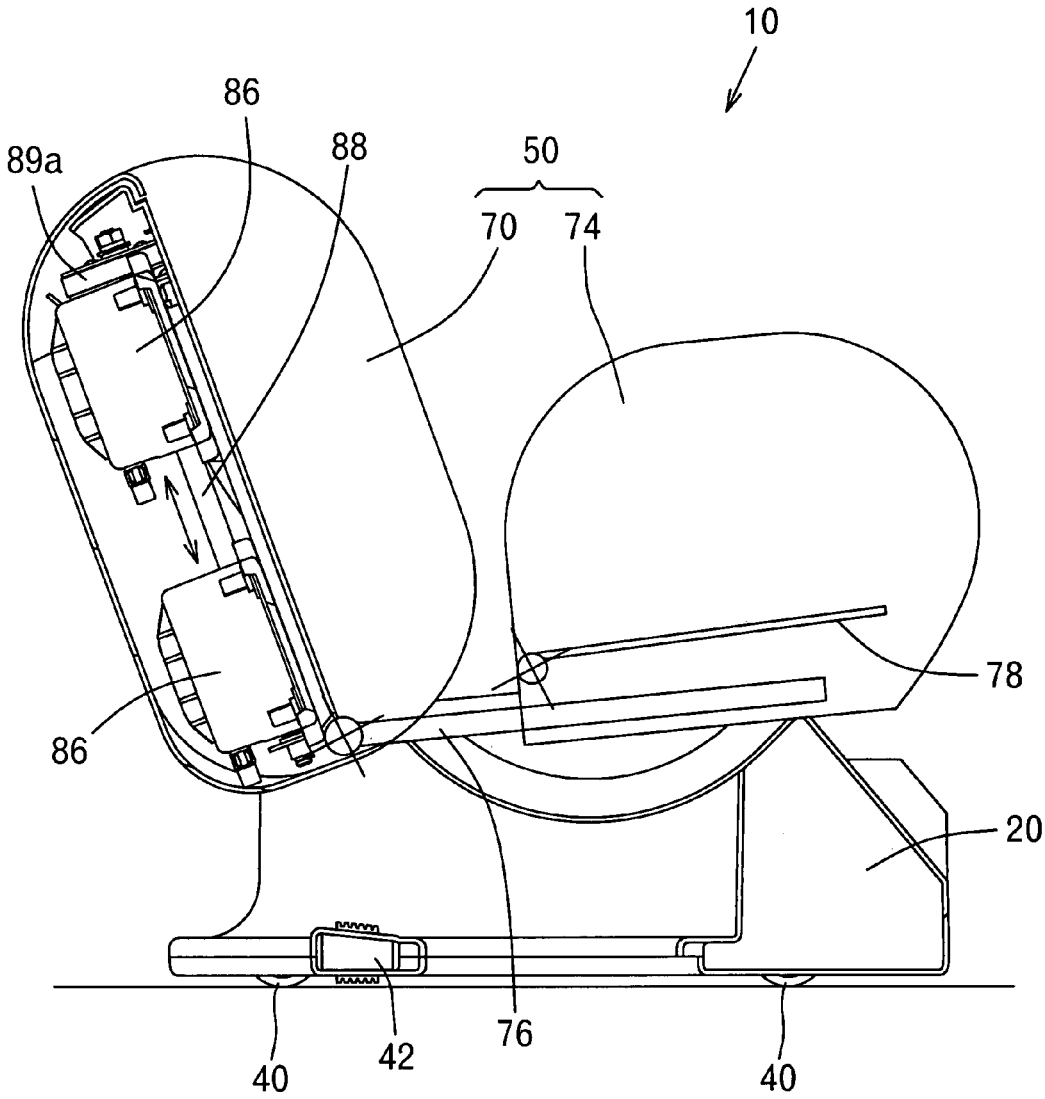
FIG. 25 is a sectional view of the leg massage machine wherein leg receiving portions are provided upwardly and downwardly slidably and tiltably relative to recessed receiving portions.

According to Embodiment 1 described, the reclining movable assembly 50 is provided with the recessed receiving portions 70 and leg receiving portions 74 integrally therewith, whereas the recessed receiving portions 70 may be made separate from the leg receiving portions 74, the leg receiving portions 74 being connected to the recessed receiving portions 70 by a connecting mechanism 76 which is movable upward and downward and can be inclined forward and rearward as shown in FIGS. 24 and 25. The massage means provided on the leg receiving portions 74 can then be adjusted to the desired level of the calves to give massage to the user. Furthermore, the angle between the foot and the calf is adjustable to a desired value for massaging.

Further in addition to the connecting mechanism 76, a mechanism 78 may be provided for the leg receiving portion 74 for adjusting the angle between the calf and the foot as shown in FIGS. 24 and 25. The user can then be given massage with the angle between the calf and the foot adjusted to the desired value.

The present invention provides a useful leg massage machine wherein a reclining assembly having recessed receiving portions and leg receiving portions is rockingly movable relative to a base assembly.

Apparently, the invention can be altered or modified by one skilled in the art without departing from the spirit of the invention. Such modifications are included within the scope of the invention as set forth in the appended claims.

What is claimed is:

1. A leg massage machine having recessed receiving portions for inserting the respective feet of the user and leg receiving portions for inserting the respective calves of the user, the recessed receiving portions and the leg receiving portions each having massage means on a side wall and/or a bottom wall thereof, the leg massage machine having:

a base assembly to be placed on a floor, and a reclining movable assembly rockingly movable forward and rearward relative to the base assembly, the recessed receiving portions and the leg receiving portions being provided in the reclining movable assembly and movable together rockingly.

2. The leg massage machine according to claim 1 wherein the massage means provided on the side wall and/or the bottom wall of each of the recessed receiving portions and the leg receiving portions is an air bag, and the base assembly is provided with an air pump for supplying compressed air to the air bag.

3. The leg massage machine according to claim 2 wherein a pipe for causing the air bag to communicate with the air pump therethrough has an electromagnetic valve, and the electromagnetic valve is disposed in the reclining movable assembly, the electromagnetic valve having a plunger reciprocatingly movable horizontally relative to a floor and in a direction orthogonal to the direction of rocking movement of the reclining assembly.

4. The leg massage machine according to claim 1 wherein the recessed receiving portions and the leg receiving portions are provided in the reclining movable assembly integrally therewith and are recessed.

5. The leg massage machine according to claim 1 wherein the reclining movable assembly is supported by the base assembly so that the center of rocking movement thereof shifts with the angle of rocking.

6. The leg massage machine according to claim 1 wherein at least one of the base assembly and the reclining movable assembly has a curved rail, and the other of the assemblies has a roller slidable along the rail.

7. The leg massage machine according to claim 6 wherein at least two rollers are arranged at front and rear different positions.

8. The leg massage machine according to claim 6 wherein the base assembly and the reclining movable assembly have the curved rail and the roller slidable along the rail, respectively.

9. The leg massage machine according to claim 1 wherein the reclining movable assembly has a center of gravity positioned to the front of the center of rocking movement when the user places his feet in the recessed receiving portions to apply the entire load.

10. The leg massage machine according to claim 1 wherein the reclining movable assembly has its center of gravity adjusted in position so as to be positioned as raised most from the base assembly when free of any load.

11. The leg massage machine according to claim 1 wherein the reclining movable assembly is so urged as to be positioned as raised most from the base assembly when free of any load.

12. The leg massage machine according to claim 1 wherein the base assembly is provided on a bottom wall thereof with brake means for preventing the base assembly from moving forward or rearward relative to a floor.

13. The leg massage machine according to claim 12 wherein the base assembly is provided on the bottom wall thereof with wheels enabling the base assembly to move relative to the floor.

14. The leg massage machine according to claim 12 wherein the brake means has a brake member having an upper end movable into contact with the reclining movable assembly and a lower end projectable from or retractable into the bottom wall of the base assembly, and the brake member is biased upward and pushed down by the movable assembly to have its lower end brought into contact with the floor when the movable assembly is subjected to a load of not smaller than a predetermined value.

15. The leg massage machine according to claim 13 wherein each of the wheels is supported by a wheel housing formed in the bottom wall of the base assembly upwardly or downwardly movably, the wheel being biased downward, and the wheel is pushed up into the base assembly and brought into bearing contact with a portion of the wheel housing when the reclining movable assembly is subjected to a load of not smaller than a predetermined value, whereby the wheel becomes nonrotatable to provide the brake means.

16. The leg massage machine according to claim 13 wherein each of the wheels is supported by a wheel housing formed in the bottom wall of the base assembly upwardly or downwardly movably, the wheel being biased downward, a brake member being provided on the bottom wall of the base assembly, and the wheel is pushed up into the base assembly to bring the brake member into contact with the floor when the reclining movable assembly is subjected to a load of not smaller than a predetermined value, whereby the wheel becomes nonrotatable to provide the brake means.

* * * * *